US008689673B2

(12) United States Patent
Berkun

(10) Patent No.: US 8,689,673 B2
(45) Date of Patent: Apr. 8, 2014

(54) ENERGY CONVERSION DEVICES AND SYSTEMS INCLUDING THE SAME

(76) Inventor: Andrew C. Berkun, Arcadia, CA (US)

( * ) Notice: Subject to any disclaimer, the term of this patent is extended or adjusted under 35 U.S.C. 154(b) by 755 days.

(21) Appl. No.: 12/936,719

(22) PCT Filed: Apr. 10, 2009

(86) PCT No.: PCT/US2009/040150

§ 371 (c)(1),
(2), (4) Date: Oct. 7, 2010

(87) PCT Pub. No.: WO2009/129129

PCT Pub. Date: Oct. 22, 2009

(65) Prior Publication Data

US 2011/0030548 A1 Feb. 10, 2011

Related U.S. Application Data

(60) Provisional application No. 61/045,960, filed on Apr. 17, 2008.

(51) Int. Cl.
*F15B 13/16* (2006.01)

(52) U.S. Cl.
USPC ..... 91/247; 91/250; 91/268; 91/273; 91/275

(58) Field of Classification Search
USPC ..... 91/5, 156, 245, 247, 250, 265, 268, 91/273, 275; 290/4 B; 137/517, 529; 251/65
See application file for complete search history.

(56) References Cited

U.S. PATENT DOCUMENTS

| | | | | | |
|---|---|---|---|---|---|
| 1,003,348 | A | * | 9/1911 | English | 91/272 |
| 2,649,078 | A | | 8/1953 | Kelly | |
| 2,691,965 | A | * | 10/1954 | Honegger | 91/268 |
| 4,168,655 | A | * | 9/1979 | Kitrilakis et al. | 91/240 |
| 4,586,426 | A | | 5/1986 | Dibrell et al. | |
| 4,631,455 | A | * | 12/1986 | Taishoff | 318/37 |
| 4,676,139 | A | | 6/1987 | Weiswurm | |
| 4,981,068 | A | * | 1/1991 | Glass et al. | 91/268 |
| 6,185,944 | B1 | | 2/2001 | Gaul | |
| 6,626,079 | B1 | | 9/2003 | Rehkemper et al. | |
| 8,448,440 | B2 | * | 5/2013 | Peoples et al. | 60/712 |
| 2007/0204814 | A1 | | 9/2007 | Scuderi | |

FOREIGN PATENT DOCUMENTS

| | | | |
|---|---|---|---|
| DE | 199 38 543 | A1 | 2/2001 |
| DE | 199 43 993 | A1 | 3/2001 |
| FR | 2142459 | A | 1/1973 |
| FR | 2676503 | A | 11/1992 |
| GB | 742870 | A | 1/1956 |

OTHER PUBLICATIONS

PCT International Search Report and Written Opinion dated Jul. 29, 2009 for PCT App. Ser. No. PCT/US09/40150.

* cited by examiner

*Primary Examiner* — Edward Landrum
*Assistant Examiner* — Logan Kraft
(74) *Attorney, Agent, or Firm* — Henricks, Slavin & Holmes LLP

(57) ABSTRACT

Methods and apparatus for converting energy from a stream of compressed gas into mechanical work as systems incorporating such methods and apparatus.

29 Claims, 21 Drawing Sheets

ENERGY CONVERSION DEVICES AND SYSTEMS INCLUDING THE SAME

CROSS-REFERENCE TO RELATED APPLICATIONS

This application claims the benefit of U.S. Provisional Application Ser. No. 61/045,960, filed Apr. 17, 2008 and entitled "Slam Valve Motor," which is incorporated herein by reference in its entirety.

BACKGROUND

1. Field of the Inventions

The present inventions relate generally to energy conversion.

2. Description of the Related Art

Energy conversion devices, such as vane motors, piston motors and turbines, may be used to convert a compressed gas stream into mechanical work. Vane motors and most piston motors do not allow the gas to significantly expand, and the work produced is the product of the volume of gas consumed at the intake times the pressure difference between intake and exhaust. Turbines are expansion-based devices and produce more work from a given gas stream than non-expansion devices. Turbines must run at relatively high blade speeds and, accordingly, are well suited for relatively large applications. As the size of the turbine blades decreases, the speed at which the turbines must rotate increases. The increase in rotational speed makes smaller bladed turbines harder to build and decreases their lifespan, as compared to their larger counterparts. The present inventor has, therefore, determined that other types of expansion-based energy conversion devices would be desirable.

SUMMARY

An energy conversion device in accordance with at least some of the present inventions includes a cylinder, a piston located within the cylinder, an intake valve associated with a first longitudinal end of the cylinder and including outlet and a movable intake valve member movable biased to an open position, a protrusion carried by the piston or the intake valve member such that the piston moves the intake valve member to the open position when the piston is adjacent to the intake valve, and an exhaust valve associated with the first longitudinal end of the cylinder and including an outlet and a movable exhaust valve member biased to an open position.

An energy conversion device in accordance with at least some of the present inventions includes a cylinder defining first and second longitudinal ends and including an exhaust port between the longitudinal ends, a piston located within the cylinder that is movable through an expansion stroke having an end and a return stroke and that covers exhaust port during at least a portion of the expansion stroke and uncovers the exhaust port near the end of the expansion stroke, an intake valve associated with the first longitudinal end of the cylinder and including outlet and a movable intake valve member biased to and open position by a biasing force and a protrusion carried by the piston or the intake valve member such that the piston moves the intake valve member to the open position when the piston is adjacent to the intake valve.

Other inventions include systems that include the present energy conversion devices. Such systems include, but are not limited to, electrical power generation, heating, cooling, and vehicle power systems.

The above described and many other features and attendant advantages of the present inventions will become apparent as the inventions become better understood by reference to the following detailed description when considered in conjunction with the accompanying drawings.

BRIEF DESCRIPTION OF THE DRAWINGS

Detailed description of exemplary embodiments will be made with reference to the accompanying drawings.

DETAILED DESCRIPTION OF EXEMPLARY EMBODIMENTS

The following is a detailed description of the best presently known modes of carrying out the inventions. This description is not to be taken in a limiting sense, but is made merely for the purpose of illustrating the general principles of the inventions.

Figure 1:
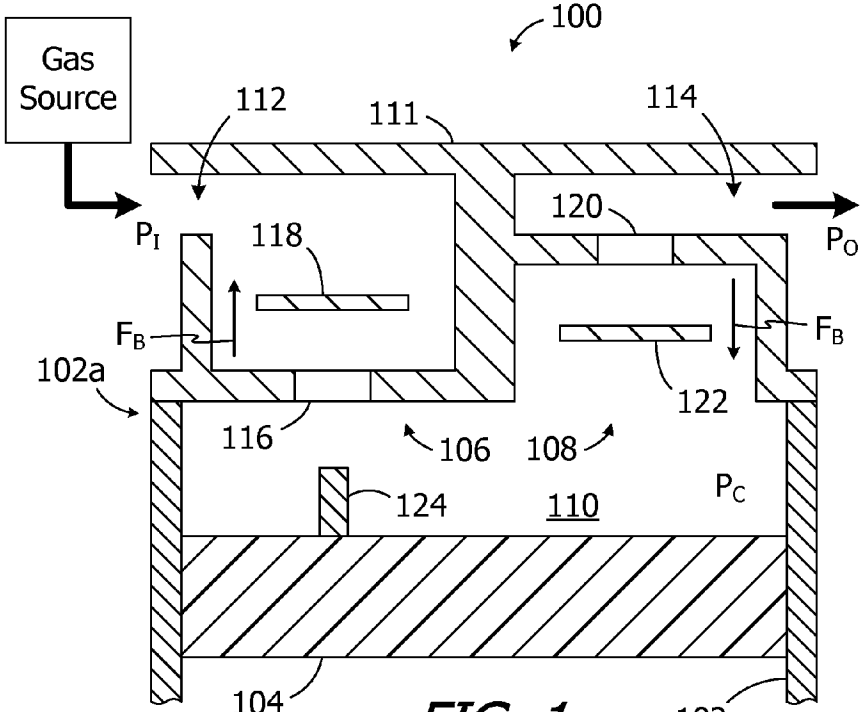
FIG. 1 is a schematic section view of an energy conversion device in accordance with one embodiment of a present invention.

As illustrated in FIG. 1, one example of an energy conversion device in accordance with at least some of the present inventions includes a cylinder 102, a piston 104 that reciprocates within the cylinder, an intake valve 106 and an exhaust valve 108. The inlet and exhaust valves 106 and 108 are associated with cylinder end 102*a*. A chamber 110 is located within the cylinder 102 between the piston 104 and the valves 106 and 108. A gas source provides compressed gas that enters the chamber 110 by way of a manifold 111 which has an inlet 112 that is in communication with the intake valve 106. The intake valve 106, exhaust valve 108 and manifold 111 may be together referred to as the energy conversion device header. Suitable compressed gasses include, but are not limited to, steam, refrigerant, and compressed air. The gasses may also include a small amount of oil or liquid other than oil. Expanded gas exits the chamber 110 by way of the exhaust valve 108 and the manifold outlet 114. In some implementations, the manifold outlet 114 will vent to ambient. The intake valve 106 has an outlet 116 and a movable valve member 118. The valve member 118, which is biased to the open position illustrated in FIG. 1 by a biasing force $F_B$, is movable between the open position and a closed position where the valve member covers the outlet 116 and prevents flow through the outlet by creating a seal with the surface around the outlet. The exhaust valve 108 has an outlet 120 and a movable valve member 122. The valve member 122, which is biased to the open position illustrated in FIG. 1 by a biasing force $F_B$, is movable between the open position and a closed position where the valve member covers the outlet 120 and prevents flow through the outlet by creating a seal with the surface around the outlet. The biasing force $F_B$ on each valve member, which may be the same or different, is relatively small. A protrusion 124, which may be carried by the piston 104 or the intake valve member 118, is carried on the piston in the illustrated example.

The operation of the exemplary energy conversion device 100 is described below with reference to FIGS. 2A-2L in the context of a single cycle which consists of an expansion stroke and a return stroke. Depending on the size length of the cylinder 102 and the speed of the piston 104, a cycle may take from 0.01 to 1 seconds to complete in some embodiments. In the illustrated orientation, the expansion stroke is down and the return stroke is up. The pressure of the gas at the manifold inlet 112 is represented by $P_I$, the pressure of the gas within the chamber 100 is represented by $P_C$, and the pressure of the gas at the manifold outlet 114 is represented by $P_O$. Although the present inventions are not limited to any particular pressures, the inlet pressure $P_I$ is 200 psig and outlet pressure $P_O$ is 0 psig. Gas is continuously supplied to the manifold inlet 112 at the inlet pressure throughout the cycle.

Figure 2A:
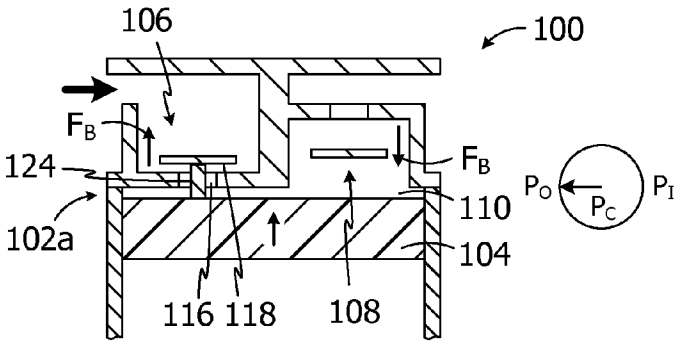
FIGS. 2A-2L are schematic section views showing the operation of the energy conversion device illustrated in FIG. 1.

Referring first to FIG. 2A, the exemplary energy conversion device 100 is shown at the point of the cycle where the piston 104 is moving toward cylinder end 102*a* as part of the return stroke. The location of the piston 104 is such that the protrusion 124 is engaged with the intake valve member 118 and has just moved the intake valve member away from the outlet 116, thereby opening the previously closed intake valve 106. The exhaust valve 108 is also open. The manner in which the inlet and exhaust valves 106 and 108 arrive at the respective closed and open states is described below. The pressure $P_C$ within the chamber 110 is equal to outlet pressure $P_O$ due to the fact that the intake valve 106 was closed and the exhaust valve 108 is open.

Figure 2B:
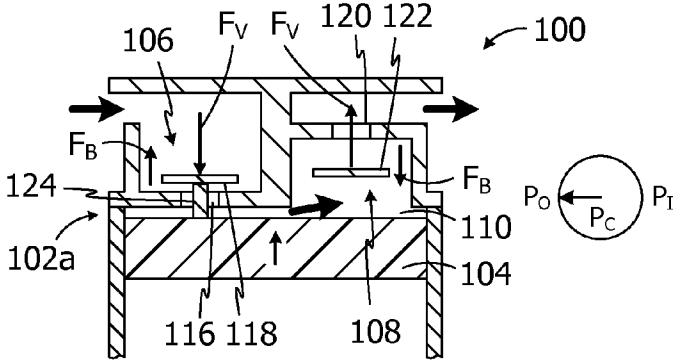

As the piston 104 continues to move toward the cylinder end 102*a* and the intake valve 106 is held open by the protrusion 124, compressed gas flows rapidly through the chamber 110 and the exhaust valve 108 as shown in FIG. 2B. This flow, which may be referred to as "blow-by," clears liquid that may have accumulated on the surface of the piston 104. The rapid flow of gas through the outlets 116 and 120 creates vacuum forces $F_V$ that act on the inlet and exhaust valve members 118 and 122 against the biasing forces $F_B$. The pressure $P_C$ within the chamber 110 remains equal to outlet pressure $P_O$ due to the fact that the exhaust valve 108 is open.

Figure 2D:
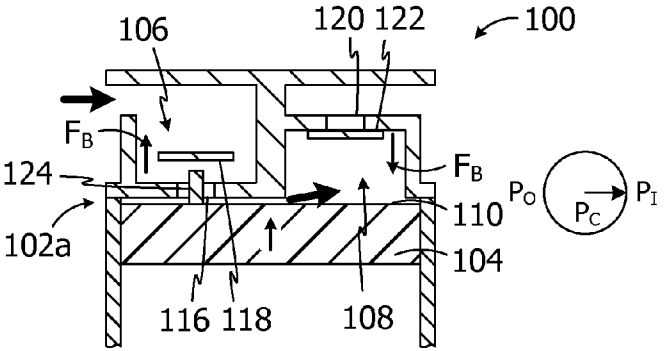
Figure 2C:
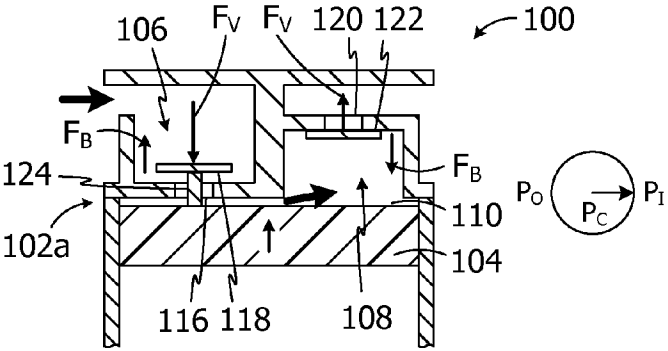

Turning to FIG. 2C, as the piston 104 continues to move toward the cylinder end 102*a*, the vacuum force $F_V$ acting on the exhaust valve member 122 will overcome the biasing force $F_B$ and cause the exhaust valve 108 to slam shut when the velocity of the gas flow reaches the velocity referred to herein as the "critical velocity." The intake valve 106, on the other hand, is held open by the protrusion 124 despite the vacuum force $F_V$ acting on the intake valve member 118. The pressure $P_C$ within the chamber 110 will increase almost immediately to inlet pressure $P_I$ due to the fact that the exhaust valve 108 has closed.

The equalization of the pressure on either side of the intake valve 106 as the piston 104 approaches the end of the return stroke allows the biasing force $F_B$ to drive the intake valve member 118 to the fully open position illustrated in FIG. 2D. The intake valve member 118 is spaced from the protrusion when in the fully open position. The pressure differential across the exhaust valve member 122 is strong enough keep the exhaust valve 108 closed despite the biasing force $F_B$. The pressure $P_C$ within the chamber 110 remains equal to inlet pressure $P_I$.

It should be noted here that the movements illustrated in FIGS. 2A-2D occurs rapidly and over a small portion of the return stroke. For example, the movements illustrated in FIGS. 2A-2D may occur over the last approximately 4-9% of the return stroke in some implementations. In those implementations where a crankshaft is secured to the piston (note, for example, FIG. 6), this would be approximately the last 5 to 10 degrees of the return stroke.

Figure 2F:
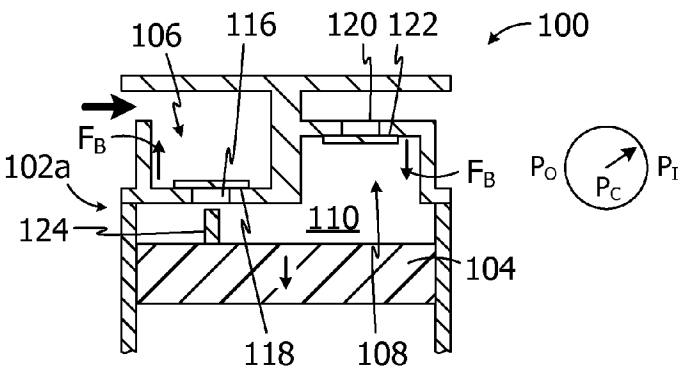
Figure 2E:
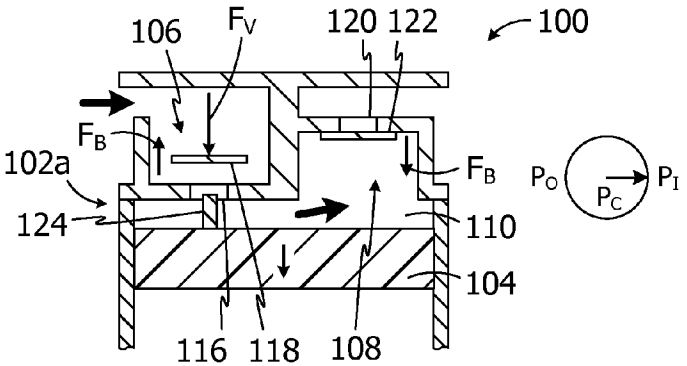

Turning to FIG. 2E, as the piston 104 begins to move away from the cylinder end 102*a* at the beginning of the expansion stroke, gas moves through the intake valve outlet 116. The flow of gas through the intake valve outlet 116 creates a vacuum force $F_V$ on the intake valve member 118 that opposes the biasing force $F_B$. As the piston moves, the work generated is equal to $(P_I-P_O)\times V_C$, where $V_C$=chamber volume. The velocity of the piston 104 increases with distance from the cylinder end 102*a*. As the velocity of the piston 104 increases, the velocity of the gas passing through the intake valve outlet 116 increases, as does the vacuum force $F_V$ acting on the intake valve member 118. The pressure $P_C$ within the chamber 110 remains equal to inlet pressure $P_I$. The pressure differential across the exhaust valve member 122 is strong enough keep the exhaust valve 108 closed despite the biasing force $F_B$.

The increases in piston velocity, gas velocity and vacuum force $F_V$ will continue until the gas velocity reaches the "critical velocity" and the vacuum force $F_V$ exceeds the biasing force $F_B$. At that point, the intake valve 106 will slam shut as shown in FIG. 2F and no more gas will enter the chamber 110 during the expansion stroke. The pressure $P_C$ within the chamber 110 will decrease from the inlet pressure $P_I$ as the piston 104 continues to move away from the cylinder end 102*a* and the gas within the chamber expands and cools. The pressure differential across the exhaust valve member 122, albeit lower, remains strong enough keep the exhaust valve 108 closed despite the biasing force $F_B$.

It should be noted here that the point in the expansion stroke at which the intake valve 106 closes is a function of the gas velocity and the area under the edges of the valve member 118. The faster the piston is moving, the higher the gas velocity and the sooner the intake valve 106 will close. This prevents runaway. The lesser the area under the edges of the valve member 118, the sooner the intake valve 106 will close. This aspect of the operation of the present energy conversion devices is discussed below in the context of FIG. 3.

Figure 2H:
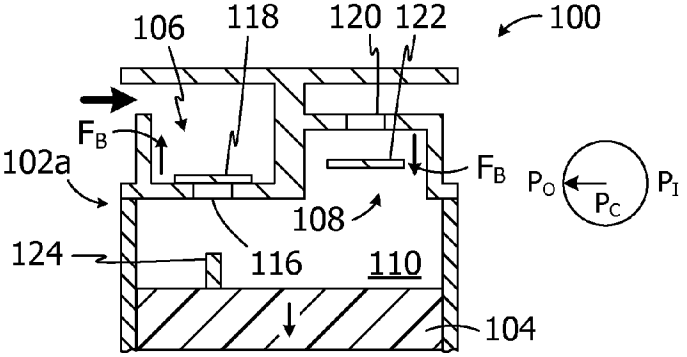
Figure 2G:
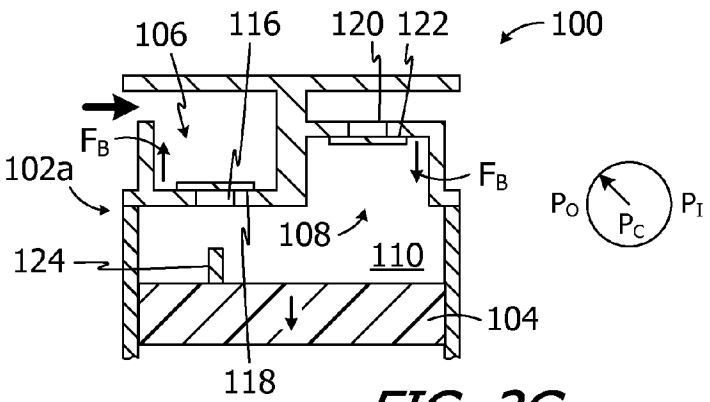

Referring to FIG. 2G, as the expansion stroke continues and the piston 104 continues to move away from the cylinder end 102*a*, the pressure $P_C$ within the chamber 110 will continue to decrease and the gas will continue to expand and cool. The work associated with this portion of the expansion stroke is the integral of $(P_C-P_O)\times\Delta V_C$. The inlet and outlets valves 106 and 108 remain closed. More specifically, the pressure differential across the intake valve member 118 due to the relatively high inlet pressure $P_I$ will keep the intake valve 106 closed despite the biasing force $F_B$. Similarly, the pressure differential across the exhaust valve member 122 due to the relatively low outlet pressure $P_O$ will keep the exhaust valve 108 closed despite the biasing force $F_B$.

Continued movement of the piston 104*a* away from the cylinder end 102*a* during the expansion stroke will result in the pressure $P_C$ within the chamber 110 decreasing to the outlet pressure $P_O$, as shown in FIG. 2H. The biasing force on the exhaust valve member 122 will open the exhaust valve 108 as the pressure $P_C$ within the chamber 110 approaches the outlet pressure $P_O$. The pressure differential across the intake valve member 118 due to the relatively high inlet pressure $P_I$ will keep the intake valve 106 closed despite the biasing force $F_B$. The inlet and exhaust valves 106 and 108 will respectively remain closed and open, and the pressure $P_C$ within the chamber 110 will remain at the outlet pressure $P_O$, as the piston 104 reaches the end of the expansion stroke (FIG. 2I).

Figure 2J:
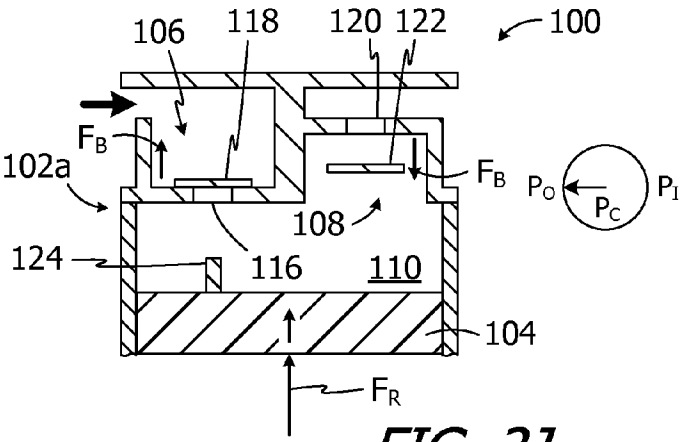
Figure 2I:
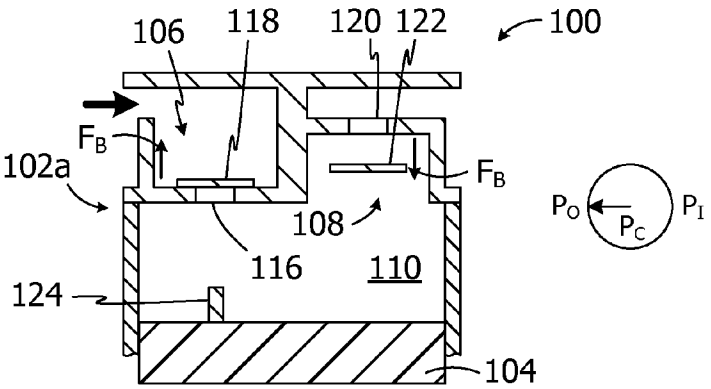
Figure 2L:
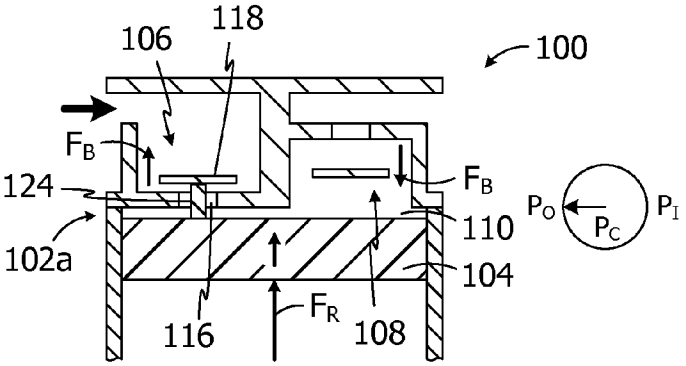
Figure 2K:
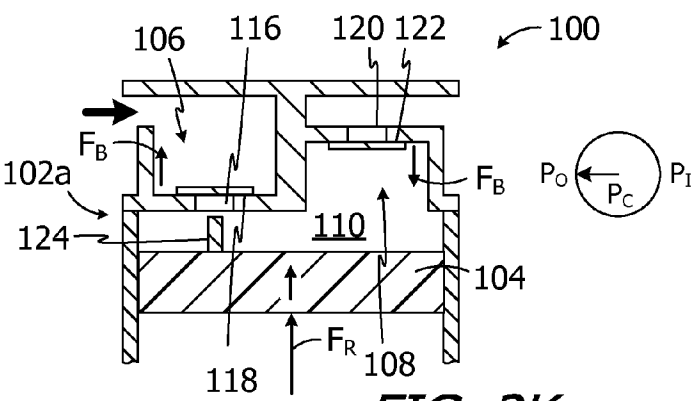

Turning to FIGS. 2J and 2K, the piston 104 will be driven through the return stroke by a return force $F_R$. The return force $F_R$ may be provided in a variety of ways, such as by way of the momentum associated with a crank shaft or by gas entering and expanding within a chamber on the other side of the piston 104, as is discussed in greater detail below. As the return stroke proceeds, the pressure $P_C$ within the chamber 110 will remain at the outlet pressure $P_O$. The velocity of the expanded and cooled gas exiting the chamber 110 by way of the exhaust valve port 120 is not high enough to create a vacuum force sufficient to close exhaust valve. The piston 104 will continue to move toward the cylinder end 102*a*, and the pressure $P_C$ within the chamber 110 will remain at the outlet pressure $P_O$, until the projection 124 opens the intake valve 106 (FIG. 2L) and the cycle is repeated.

To briefly summarize, the intake valve 106 is normally open, but will close if the gas flow rate through the valve exceeds critical value and will remain closed so long as there is a pressure difference between inlet pressure $P_1$ and the pressure $P_C$ within the chamber 110. The intake valve, if closed, will be opened by mechanical interaction with the piston 104. The exhaust valve 108 is also normally open, but will close if the gas flow rate through the valve exceeds a critical value, and will remain closed so long as the pressure $P_C$ within the chamber 110 is higher than the outlet pressure $P_O$.

Figure 3:
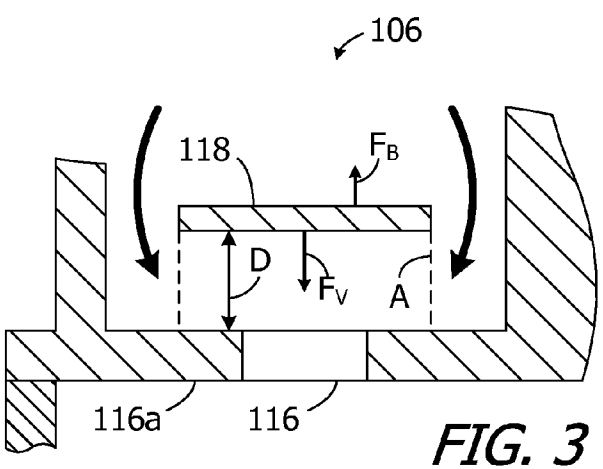
FIG. 3 is an enlarged section view of a portion of the energy conversion device illustrated in FIG. 1.

Referring to FIG. 3, the timing of the closing of the intake valve 106 during the expansion stroke controls how much compressed gas enters the expansion chamber 110 and, accordingly, how much work is produced by the exemplary energy conversion device 100. The intake valve 106 closes when the vacuum force $F_V$ created by the gas flow through the outlet 116 overcomes the biasing force $F_B$ on the intake valve member 118. The vacuum force $F_V$ is a function the velocity of the compressed gas as it passes through the cross-sectional area A, which is the area between the side edges of the intake valve member 118 and the plate 116*a* in which the outlet 116 is formed. The velocity of the gas is piston velocity times the ratio of the piston area to the cross-sectional area A. The velocity of the piston 104 is a sinusoid and depends on the cycles per second and the location of the piston. Piston velocity is zero at the ends of the strokes and is maximum at the mid-point. The smaller the cross-sectional area A, the earlier in the expansion stroke the intake valve closes. Power may, therefore, be controlled by adjusting the distance D between the plate 116*a* and the intake valve member 118.

Figure 4:
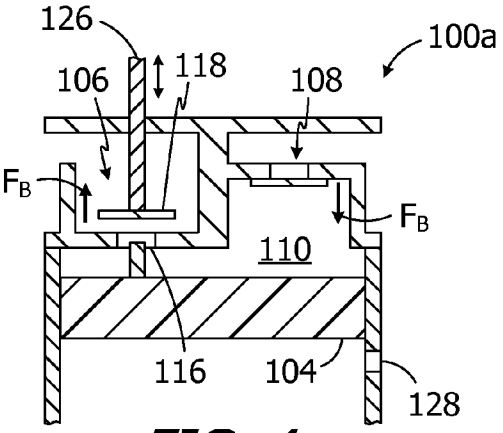
FIG. 4 is a schematic section view of an energy conversion device in accordance with one embodiment of a present invention.

One exemplary mechanism for controlling the distance D between the plate 116*a* and the intake valve member 118 and, accordingly, the cross-sectional area A and the work produced by the compressed gas stream, is provided on the exemplary energy conversion device 100*a* illustrated in FIG. 4. The exemplary energy conversion device 100*a* is essentially identical to energy conversion device 100 and similar elements are represented by similar reference numerals. Here, however, a control rod 126 may be used to act against the biasing force $F_B$ and to prevent the intake valve member 118 from reaching the fully open position illustrated in FIG. 3 if so desired. The control rod 126 is movable relative to the intake valve member 118 between a position that will allow the intake valve member 118 to reach its fully open position, and other positions that reduce the distance D and cross-sectional area A as shown in FIG. 4. The control rod 126 may be slidable and driven by, for example, a mechanical linkage, a solenoid or any other suitable actuator. The control rod 126 may be threaded and linearly movable in response to rotation thereof.

The exemplary energy conversion device 100*a* also includes an exhaust port 128 that vents to ambient or to the outlet portion of the associated manifold. The cylinder exhaust port 128, which is uncovered by the piston 104 near the end of the expansion stroke, significantly increases peak torque and substantially reduces the likelihood that the energy conversion device will stall, but reduces the displacement of the energy conversion device. Additional detail concerning exhaust ports is presented below in with reference to FIG. 35.

Figure 6:
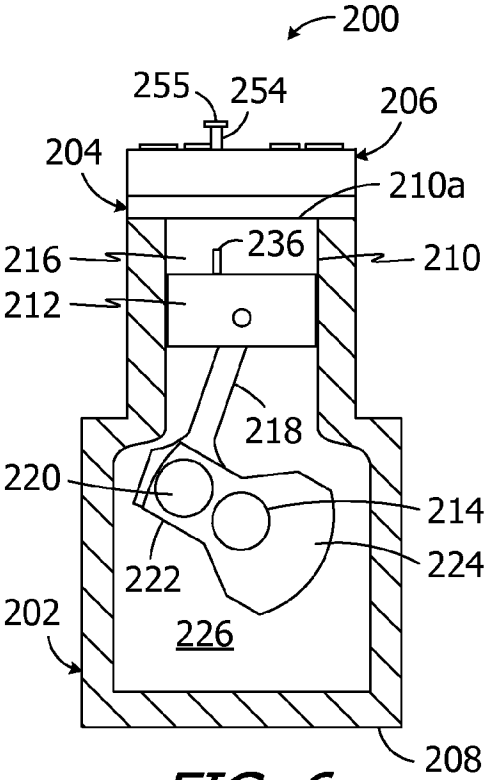
FIG. 6 is a partial section view take along line 6-6 in FIG. 5.
Figure 5:
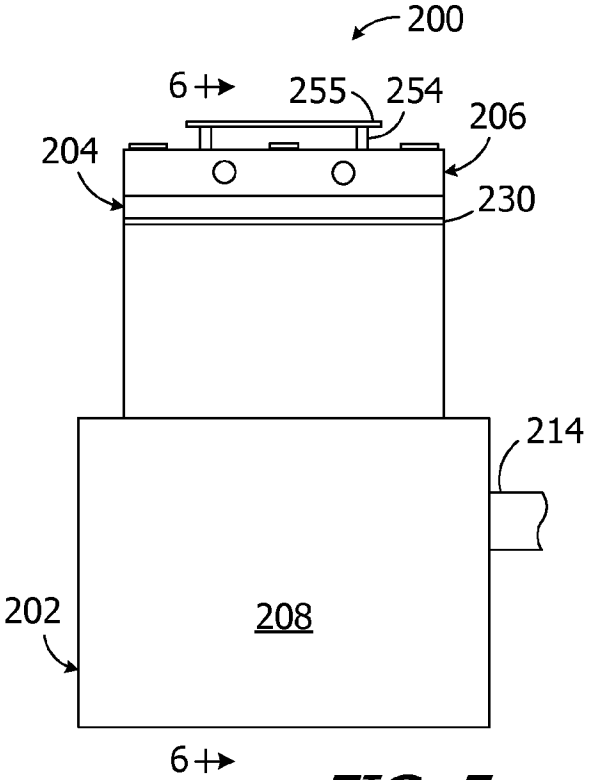
FIG. 5 is a side view of an energy conversion device in accordance with one embodiment of a present invention.

Another exemplary energy conversion device is generally represented by reference numeral 200 in FIGS. 5 and 6. The energy conversion device 200, which may be used in conjunction with a device that supplies a continuous stream of compressed gas thereto, includes a piston and cylinder assembly 202, a valve assembly 204 and a manifold 206. The valve assembly 204 and a manifold 206 may be together referred to as a header. The exemplary piston and cylinder assembly 202 is a conventional device, such as that commonly found in internal combustion engines and compressors, which has a block 208 with a pair of cylinders 210, a pair of pistons 212 and a crankshaft 214. Chambers 216 extend from the cylinder ends 210*a* to the pistons 212. Each piston 212 is connected to the crankshaft 214 by a connecting rod 218, a rod bearing 220, and a rod journal 222. There is also a counterweight 224 associated with each of the pistons 212. A lubricant such as oil may be stored in a sump area 226 and/or injected into the gas stream. In those instances where the lubricant is to be injected, a check valve (not shown) may be provided at the top of each cylinder 210 to inject oil at low pressure when the piston is not pressurized. Tubes would be provided in the valve assembly 204 and manifold 206 at appropriate locations. Such an arrangement tends to keep the lubricant cooler and its residence within the cylinder shorter, thereby increasing the lubricant change interval. To accommodate possible leakage, two check valves per cylinder in series may be employed.

The pistons 212 may also include sealing rings (not shown) that provide a sliding seal between the outer edges of the pistons and the inner surfaces of the cylinders 210. The sealing rings prevent the compressed gas within the chamber 216 from leaking into the sump 226 and prevent the lubricant within the sump from leaking into the chamber. Suitable sealing rings include, but are not limited to, spring loaded rings that ride on a thin layer of lubricant on the cylinder 216. The lubricant should be compatible with the working fluid. Teflon sealing rings may be employed in those instances where the use of lubricant is undesirable.

Figure 7:
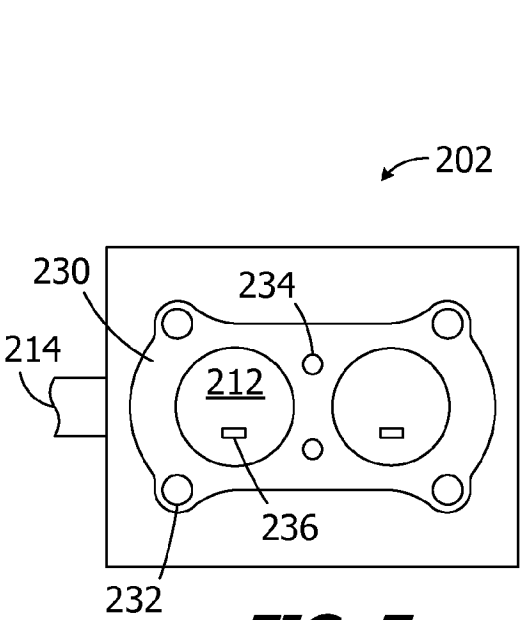
FIG. 7 is a top view of the energy conversion device illustrated in FIG. 5 with manifold and valve assembly removed.

Turning to FIG. 7, the exemplary piston and cylinder assembly 202 is provided with a mounting surface 230 for the valve assembly 204. A plurality of threaded apertures 232 and 234 are also provided. The threaded apertures 232 and 234 are used to secure the valve assembly 204 and manifold 206 to the piston and cylinder assembly 202 in the manner described below with reference to FIGS. 26A-26H. Protrusions 236, which are used to open the intake valves 238 (discussed below), are carried by and secured to the pistons 212 (FIGS. 6 and 7) in the exemplary energy conversion device 200. The protrusions may, in other implementations, be carried by the intake valves.

Although the present inventions are not limited to any particular type of piston and cylinder assembly, the exemplary piston and cylinder assembly 202 is of the type commonly found in a three horsepower air compressor. The dimensions will vary depending on the application. In one exemplary implementation, the mounting surface 230 is about 105 mm by 170 mm and the pistons are 65 mm diameter and have a 50 mm stroke. It should also be noted here that although the exemplary energy conversion device 200 includes is a two-cylinder device, other implementations may be in the form of one-cylinder devices or may have more than two cylinders.

Turning to FIGS. 5, 6 and 8-17, the exemplary valve assembly 204 is configured for use with the two-cylinder piston and cylinder assembly 202. Although the present inventions are not so limited, the exemplary valve assembly 204 has two intake valves and two exhaust valves—one intake valve 238 and one exhaust valve 240 for each cylinder 210. Additionally, although the two intake valves 238 are identical to one another, as are the exhaust valves 240, in the illustrated implementation, the present inventions also include implementations where this is not the case.

Referring more specifically to FIGS. 8-11 and 15, the exemplary intake valves 238 each include a housing 242 and a movable valve member 244. The housing 242 has a pair of valve inlets 246, an outlet 248 that is aligned with the chamber 216 (FIG. 6), a valve member region 250, and an aperture 252 for a control rod 254. The exemplary movable valve member 244 is self-biasing and is biased to the open state illustrated in FIGS. 9 and 15 by virtue of its shape and material, which are discussed in greater detail below. When an intake valve 238 is in the open state, compressed gas that enters the valve by way of the inlets 246, flows through the valve member region 250 past the movable valve member 244 and through the outlet 248 to the chamber 216. The intake valve 238 will slam closed when the velocity of the gas reaches the "critical velocity" and the vacuum force created by the compressed gas flowing through the outlet 248 overcomes the biasing force associated with the movable valve member 244 and deflects the movable valve member to the state illustrated in FIGS. 10 and 16. Here, the movable valve member 244 covers the outlet 248, thereby preventing flow through the outlet into the chamber 216, and the pressure of the compressed gas within the valve inlets 246 and valve member region 250 will prevent the biasing force associated with the movable valve member 244 from returning the valve member to the open state illustrated in FIGS. 9 and 15.

Figure 31:
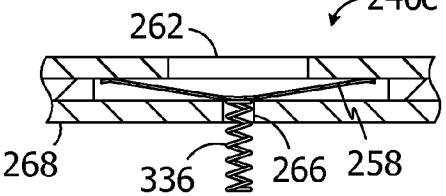
FIG. 31 is a section view of a valve in accordance with one embodiment of a present invention.
Figure 30:
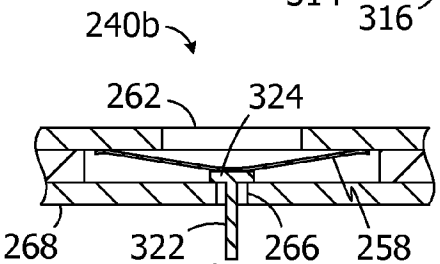
FIG. 30 is a section view of a valve in accordance with one embodiment of a present invention.

As illustrated in FIGS. 8 and 12-15, the exemplary exhaust valves 240 each include a housing 256 and a movable valve member 258. The housing 256 has a pair of valve inlets 260 that are aligned with the chamber 216 (FIG. 6), an outlet 262, a valve member region 264, and an aperture 266 that may be used for a protrusion that closes the exhaust valve, examples of which are discussed below with reference to FIGS. 30 and 31. The exemplary movable valve member 258 is self-biasing and is biased to the open state illustrated in FIGS. 13 and 15 by virtue of its shape and material, which are discussed in greater detail below. When an exhaust valve 240 is in the open state, expanded gas from the chamber 216 enters the valve by way of the inlets 260, flows through the valve member region 264 past the movable valve member 264, and flows through the outlet 262 to, for example, the manifold 206. The exhaust valve 240 will slam closed when the velocity of the expanded gas flowing through the outlet 262 reaches the "critical velocity" and the associated vacuum force overcomes the biasing force associated with the movable valve member 258 and deflects the movable valve member to the closed state illustrated in FIGS. 14 and 16. Here, the movable valve member 258 covers the outlet 262, thereby preventing flow through the outlet, and the pressure of the gas within the valve inlets 260 and valve member region 264 will prevent the biasing force associated with the movable valve member 258 from returning the valve member to the open state illustrated in FIGS. 13 and 15.

Figure 8:
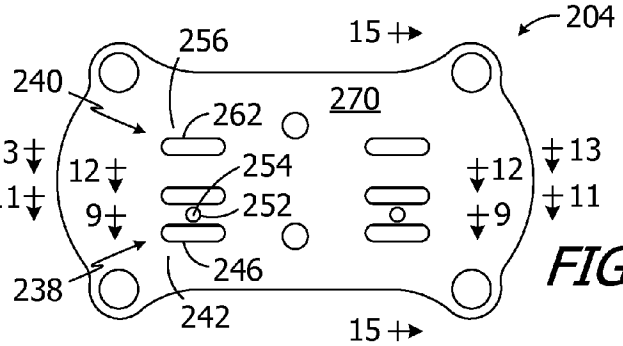
FIG. 8 is a top view of a valve assembly in accordance with one embodiment of a present invention.
Figure 12:
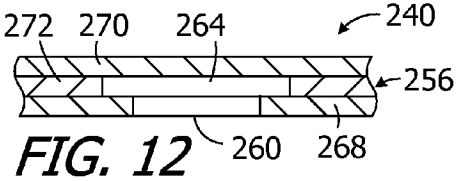
FIG. 12 is a section view take along line 12-12 in FIG. 8.
Figure 13:
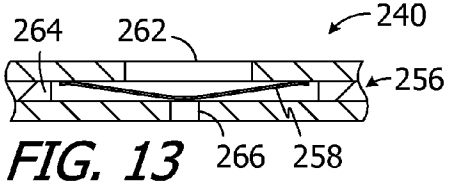
FIG. 13 is a section view take along line 13-13 in FIG. 8.
Figure 14:
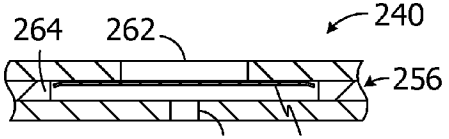
FIG. 14 is a section view showing the valve member illustrated in FIG. 13 in a closed position.
Figure 11:
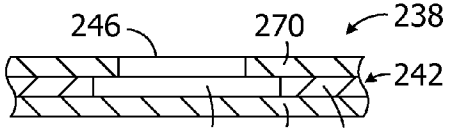
FIG. 11 is a section view take along line 11-11 in FIG. 8.
Figure 20:
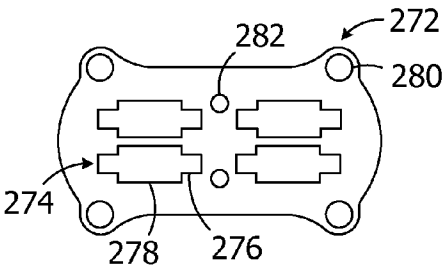
FIG. 20 is a top view of an intermediate plate in accordance with one embodiment of a present invention.
Figure 19:
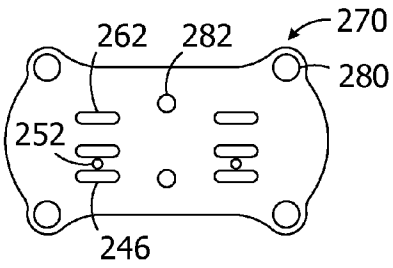
FIG. 19 is a top view of an end plate in accordance with one embodiment of a present invention.
Figure 18:
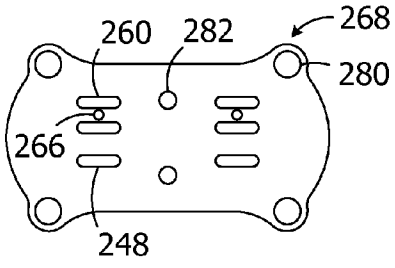
FIG. 18 is a top view of an end plate in accordance with one embodiment of a present invention.

Although the housings 242 and 256 for all four of the inlet and exhaust valves 238 and 248 are part of a common housing structure in the illustrated embodiment, the present inventions are not so limited. By way of example, but not limitation, each valve may be provided with its own separate housing or there may be a single housing structure for each inlet/exhaust valve pair in other implementations. The common housing structure in the illustrated embodiment is formed from end plates 268 and 270 and an intermediate plate 272 located therebetween (FIGS. 8, 11 and 12). Referring to FIGS. 18-20, the end plate 268, which is the plate that abuts the piston and cylinder assembly mounting surface 230 (FIG. 7), includes two pairs of valve inlets 260 for the exhaust valve 240, two ports 248 for the intake valve 238, and two apertures 266. End plate 270, which is the plate that abuts the manifold 206, includes two pairs of valve inlets 246 for the intake valve 238, two ports 262 for the exhaust valve 240 and two control rod apertures 252. The intermediate plate 272 includes four apertures 274 that define the volumes between the end plates 268 and 270 for the inlet and exhaust valve movable valve members 244 and 258. The apertures 274 each include a relatively long central portion 276 and a pair of side portions 278. The movable valve members 244 and 258 are located in the central portion 276. The side portions 278, which are aligned with the intake valve inlets 246 and the exhaust valve inlets 260, define the valve member regions 250 and 264 with the end plates 268 and 270. The end plates 268 and 270 and intermediate plate 272 also include apertures 280 and 282 that are used to secure the valve assembly 204 to the piston and cylinder assembly 202 and manifold 206 in the manner described below with reference to FIGS. 26A-26H.

The materials and dimensions of the various elements of the valve assembly 204 will depend on the intended application. Suitable materials for the end plates 268 and 270 include, but are not limited to, plated or stainless steel or anodized aluminum, while suitable materials for the intermediate plate 272 include, but are not limited to, aluminum or anodized aluminum. With respect to dimensions, in one exemplary implementation, the plates 268-272 measure 105 mm by 170 mm, The plates 268 and 270 are 5 mm thick and the plate 272 is 3 mm thick. The valve inlets 246 and 260 and outlets 248 and 262 are about 40 mm×5 mm.

Figure 15:
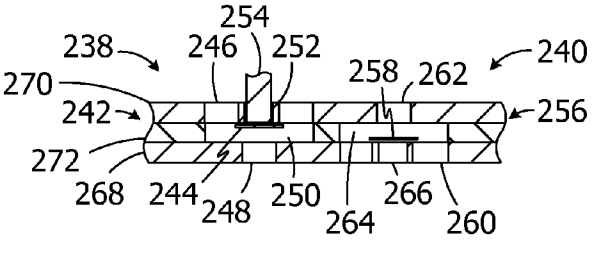
FIG. 15 is a section view take along line 15-15 in FIG. 8.
Figure 16:
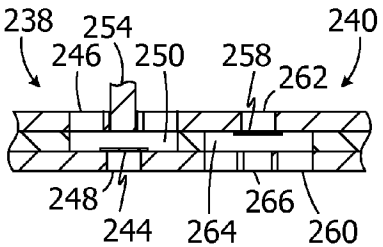
FIG. 16 is a section view showing the valve members illustrated in FIG. 15 in their respective closed positions.
Figure 17:
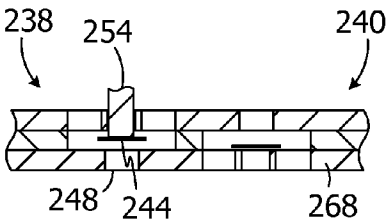
FIG. 17 is a section view showing the valve member being held by a control rod.

The control rods 254 may be used to control the distance between the intake valve movable valve members 244 and the end plate 268 in which the outlets 248 are located and, accordingly, control how much compressed gas enters the expansion chambers 216 and, accordingly, how much work is produced by the exemplary energy conversion device 200. Referring first to FIG. 15, a control rod 254 is shown in its retracted state. The distance between the apex of the valve member 244 and the end plate 268 is maximized, as is the cross-sectional area between the side edges of the valve member and the plate (note FIG. 9). The maximum distance is defined by the distance between the end plates 268 and 270, i.e. the thickness of the intermediate plate 272. The rods 254 may be used to reduce the distance between the apex of the valve member 244 and the end plate 268 in the manner illustrated in FIG. 17. As noted above, such an adjustment to the intake valve reduced the cross-sectional area between the side edges of the valve members 244 and the end plate 268 which, in turn, cause the inlets valves to close earlier in the expansion stroke. The control rods 254 pass through the manifold 206 and may be connected to a common linkage 255, as shown in FIGS. 5 and 6, or to any other suitable device that controls the movement of the control rods.

Figure 9:
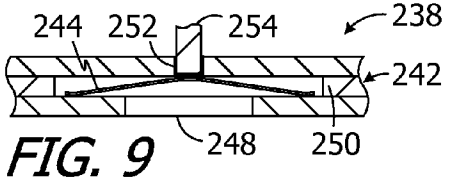
FIG. 9 is a section view take along line 9-9 in FIG. 8.
Figure 10:
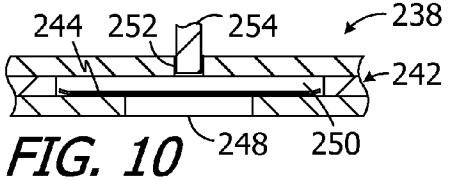
FIG. 10 is a section view showing the valve member illustrated in FIG. 9 in a closed position.
Figure 22:
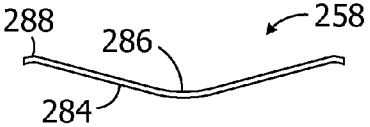
FIG. 22 is a side view of an exhaust valve movable valve member in accordance with one embodiment of a present invention.
Figure 21:
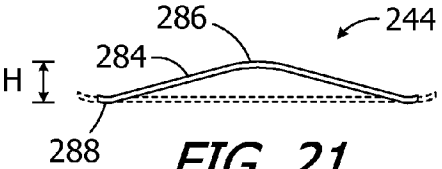
FIG. 21 is a side view of an intake valve movable valve member in accordance with one embodiment of a present invention.

As illustrated in FIG. 21, the exemplary intake valve movable valve members 244 each have a pair of planar portions 284 connected by a curved portion 286. The planar portions 284 insure that an airtight seal will be formed with the portion of the plate 268 adjacent to the outlet 248. The valve member 244 may be formed from a thin strip of resilient material that is bent or otherwise manufactured into the illustrated shape. The relaxed (or un-stressed) orientation is the solid line orientation illustrated in FIG. 21. So configured, the valve members 244 are self-biased to the fully open orientation (FIG. 9). The exemplary valve members 244 also include curved surfaces 288 near the longitudinal ends of the valve member. The curved surfaces 288 allow the longitudinal ends of the valve members 244 to slide along the surface of the end plate 268 with less friction than that which would be associated with sharp edges as the valve members move to the closed, dash line orientation illustrated in FIG. 21. Although the exhaust valve movable valve members 258 (FIG. 22) are identical in the intake valves members 244 but for orientation in the illustrated embodiment, identity is not required. With respect to materials, suitable materials for the inlet and exhaust valve members 244 and 258 include, but are not limited to, thin strips of metal such as smooth finish stainless steel or plated high carbon spring steel. In one exemplary implementation, the strips will be about 56 mm×13 mm.

Figure 25:
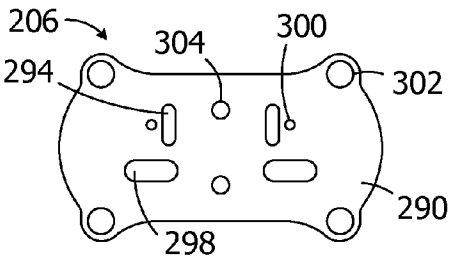
FIG. 25 is a bottom view of the manifold illustrated in FIG. 23.
Figure 24:
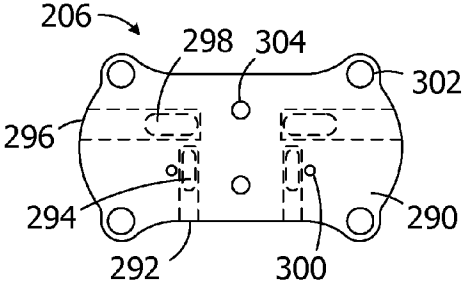
FIG. 24 is a top view of the manifold illustrated in FIG. 23.
Figure 23:
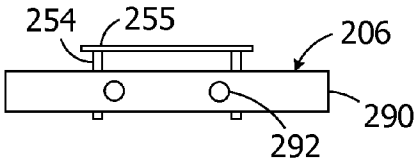
FIG. 23 is a side view of a manifold in accordance with one embodiment of a present invention carrying a control rod assembly.

Turning to FIGS. 23-25, the exemplary manifold 206 includes a block-like main body 290 with a pair of inlet apertures 292 that terminate at inlet ports 294 and a pair of outlet apertures 296 that terminate at outlet ports 298. The inlet ports 294 are positioned such that they will be aligned with at least a portion of the intake valve inlets 246, and the outlet ports 298 are positioned such that they will be aligned with the exhaust valve ports 262. A pair of apertures 300 for the control rods 254 extend through the main body 290, as do apertures 302 and 304, which are used to secure the manifold 206 to the piston and cylinder assembly 202 and the valve assembly 204 in the manner described below. It should also be noted that gaskets (not shown) may be provided between the mounting surface 230 and the valve assembly 204, between of the plates 268-272 in the valve assembly, and between the valve assembly and the manifold 206.

Figure 26A:
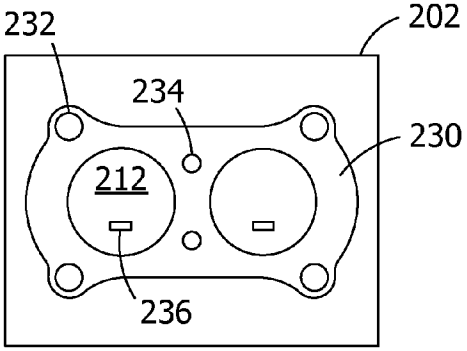
FIGS. 26A-26H are top views showing an assembly process in accordance with one embodiment of a present invention.
Figure 26B:
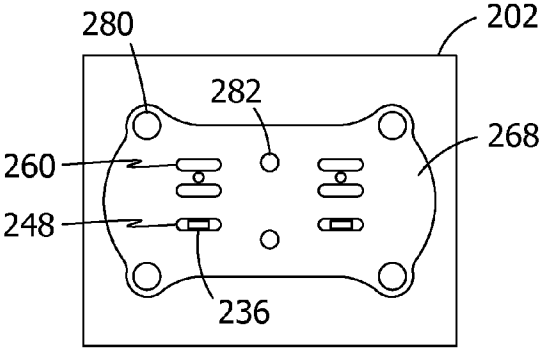
Figure 26C:
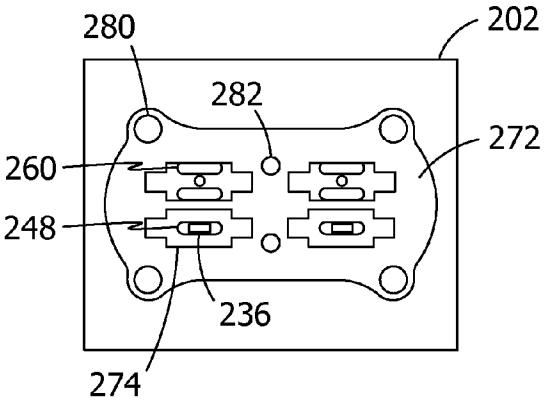
Figure 26D:
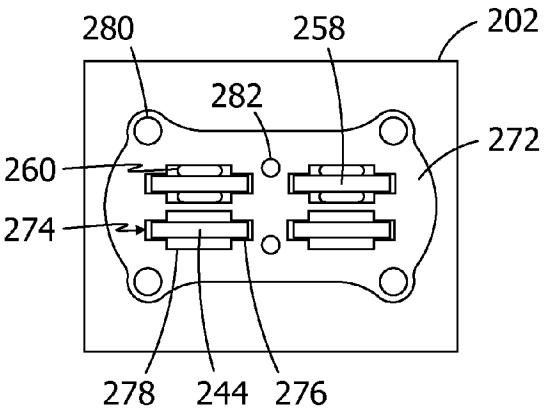
Figure 26F:
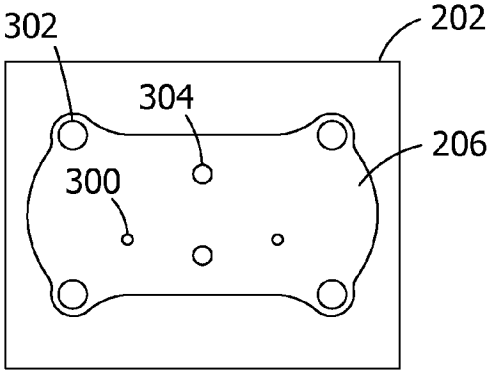
Figure 26H:
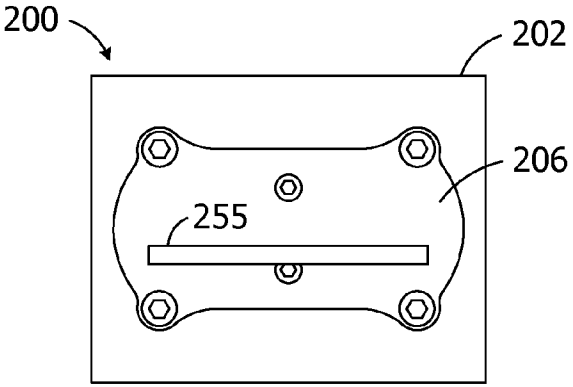
Figure 26E:
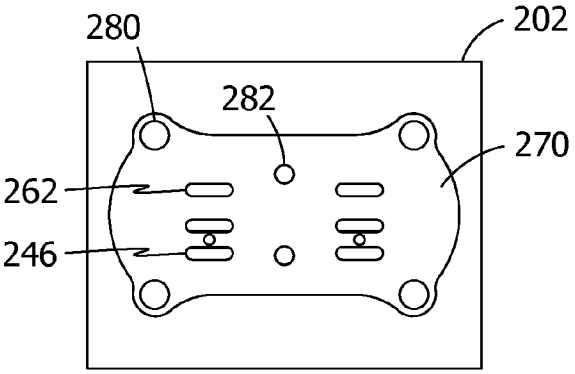
Figure 26G:
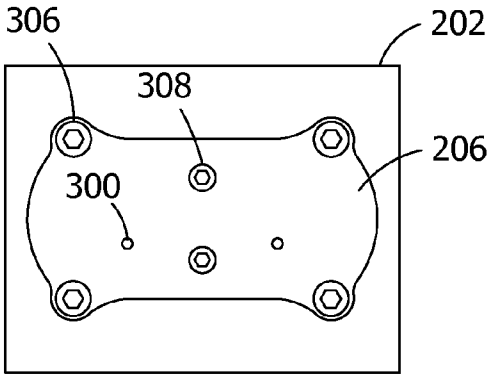

A portion of the process of assembling the exemplary energy conversion device is illustrated in FIGS. 26A-26H. The gaskets mentioned in the preceding paragraph may be employed but are omitted here to simply the discussion. The piston and cylinder assembly 202 is shown in FIG. 26A. The valve assembly end plate 268 is placed onto the piston and cylinder assembly mounting surface 230 such that the outlets 248 are aligned with the projections 236, the end plate apertures 280 and 282 are aligned with the threaded apertures 232 and 234 of the piston and cylinder assembly 202 (FIG. 26B). The valve assembly intermediate plate 272 is then placed onto the end plate 268 such that intermediate plate apertures 280 and 282 are aligned with the end plate apertures 280 and 282 (FIG. 26C). The movable valve members 244 and 258 are then positioned within the relatively long central portions 276 of the intermediate plate apertures 274 (FIG. 26D). The movable valve members 244 are offset from movable valve members 258 by 180 degree (note FIGS. 9 and 13). The valve assembly end plate 270 is placed onto the intermediate plate 272 such that the end plate apertures 280 and 282 are aligned with the intermediate plate apertures 280 and 282 (FIG. 26E). The manifold 206 is placed onto the end plate 270 such that the manifold apertures 302 and 304 are aligned with the end plate apertures 280 and 282 (FIG. 26F). Bolts 306 and 308 are passed through the manifold 206 and valve assembly plates 268-272 and are secured to the piston and cylinder assembly 202 by way of the threaded apertures 232 and 234 (FIG. 26G). The control rods 254, which are connected to the common linkage 255, are then inserted into the apertures 300 (FIG. 26H), thereby completing the energy conversion device 200.

Figure 27C:
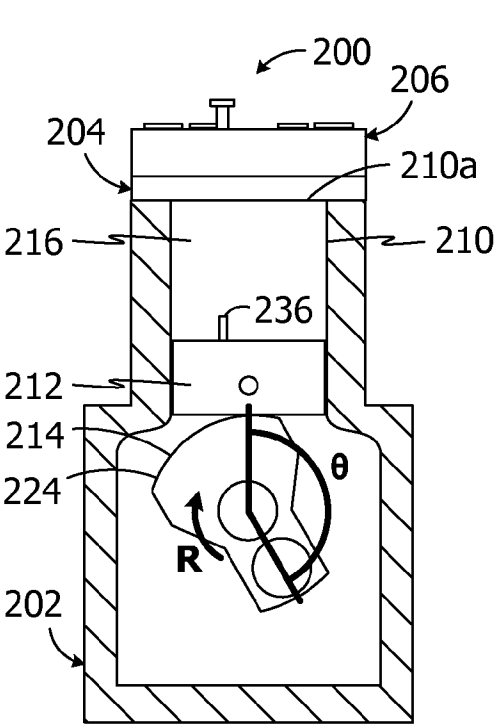
FIGS. 27A-D are partial section views showing the operation of the energy conversion device illustrated in FIGS. 5 and 6.
Figure 27B:
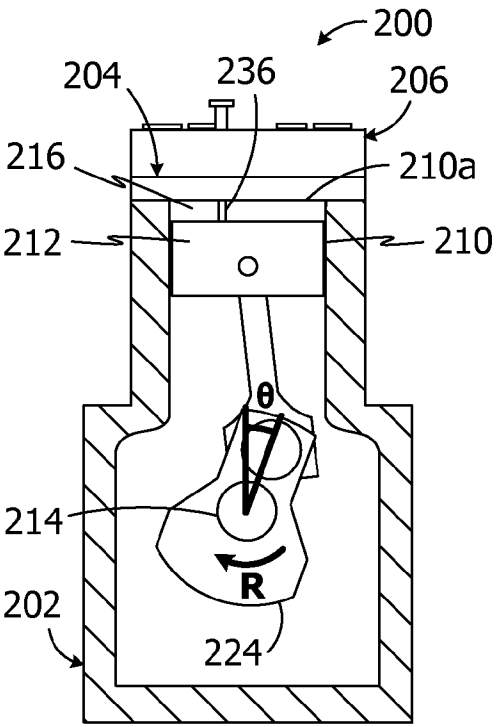
Figure 27A:
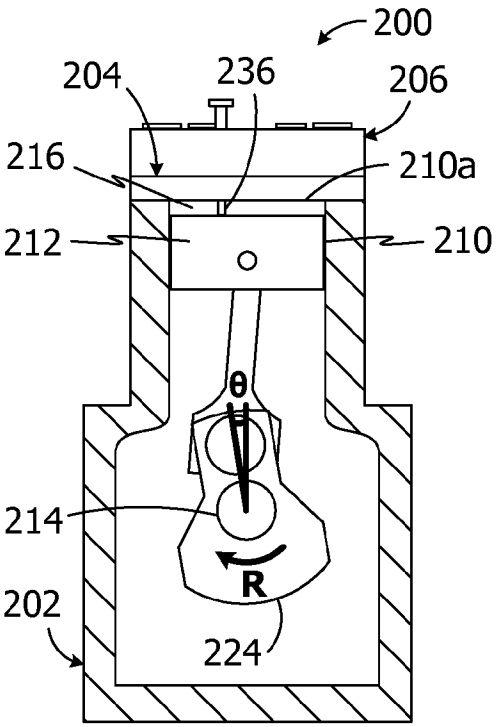
Figure 27D:
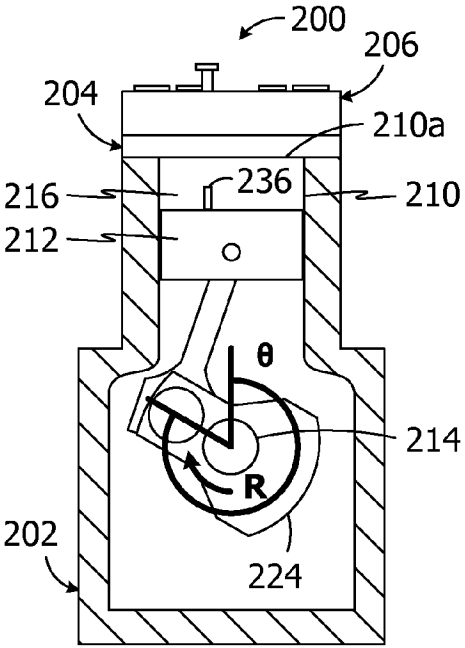

The operation of the energy conversion device 200 proceeds in the essentially the same manner as that described above with reference to the exemplary energy conversion device 100 and FIGS. 2A-2L. Although the following discussion only refers to one of the pistons 212 and the inlet and exhaust valves 238 and 240 associated therewith, it should be noted that the other piston and valve arrangement is operating in the same manner, albeit 180 degrees out of phase. Referring first to FIG. 27A, the crankshaft 214 is rotating in the direction indicated by arrow R and θ is the crankshaft angle. θ=0 degrees at the end of the return stroke and θ=180 degrees at the end of the expansion stroke. The protrusion 236 on the piston 212 will begin to open the associated intake valve 238 (FIGS. 9-11) when θ=−10 degrees (or 350 degrees), which is the angle illustrated in FIG. 27A, so that compressed gas can begin to flow into the chamber 216. At this point in the cycle, the exhaust valve 240 (FIGS. 12-14) is open, the pressure within the chamber 216 is the outlet pressure (e.g. 0 psig) and the piston 212 is being driven upwardly by the momentum associated with the counterweight 224. Rotation in the direction of arrow R will continue and, when θ=−5 degrees (or 355 degrees), the exhaust valve 240 will slam closed as the protrusion continues to hold the intake valve 238 open. The pressure within the chamber 216 will begin to rise to the inlet pressure (e.g. 200 psig) and, once the pressure across the intake valve 238 equalizes at θ=−2 degrees (or 358 degrees), the intake valve will move to its fully open position, which is not being reduced by the associated control rod 254 in this example. The expansion stroke will continue and, when θ=20 degrees (FIG. 27B), the intake valve 238 will slam shut. The pressure within the chamber 216 will continue to drop as the expansion stroke continues and the chamber volume increases. When θ=150 degrees (FIG. 27C), the pressure within the chamber 216 will be essentially equal to the outlet pressure and the self-biased exhaust valve 240 will open. The intake valve 238 will remain closed and the exhaust valve 240 will remain open, as the expansion stroke ends and the return stroke begins (θ=180 degrees). The momentum associated with counterweight 224 will drive the piston 212 through the return stroke, including the portion of the return stroke where θ=300 degrees (or −60 degrees) that is illustrated in FIG. 27D. The piston 212 will drive the lower temperature and pressure gas within the chamber 216 through the open exhaust valve 240 and the pressurized gas being supplied to the energy conversion device 200 by way of the manifold 206 will hold the intake valve 238 closed. This will continue until the piston reaches the location illustrated in FIG. 27A and the cycle is repeated.

The present energy conversion devices may are not limited, either in whole or in part, to the examples presented in FIGS. 1-27D. By way of example, but not limitation, various alternatives are presented in FIGS. 28-38.

For example, inlet and/or exhaust valves in accordance with at least some of the present inventions may be configured to facilitate selective adjustment of the biasing force associated with the movable valve members. Increasing the biasing force increases the volume of compressed gas that enters the chamber during the expansion stroke.

Figure 28:
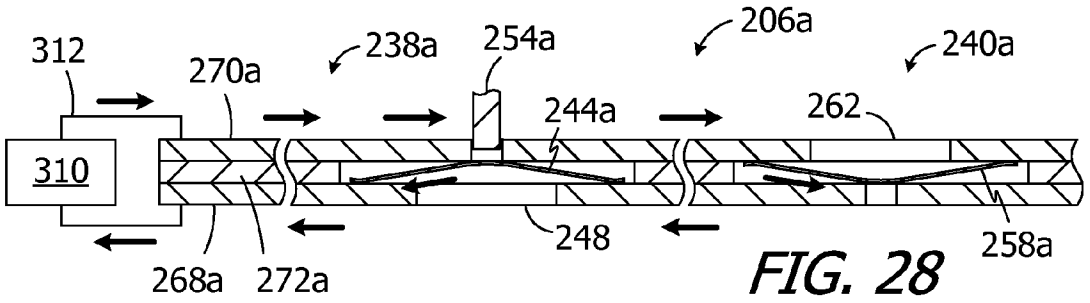
FIG. 28 is a section view of a valve assembly in accordance with one embodiment of a present invention.
Figure 29:
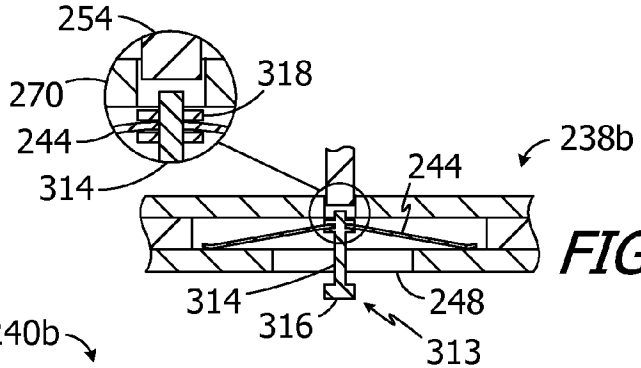
FIG. 29 is a section view of a valve in accordance with one embodiment of a present invention.

One example of a valve assembly including such valves is generally represented by reference numeral 206*a* in FIG. 28. Valve assembly 206*a* is substantially similar to valve assembly 206 and similar elements are represented by similar reference numerals. The exemplary valve assembly 206*a* is configured to employ magnetism to selectively adjust the biasing force on the movable members 244*a* and 258*a* in the valves 238*a* and 240*a*. To that end, the control rod 254*a* and end plates 268*a* and 270*a* may be formed from a magnetic material (e.g. plated iron or magnetic stainless steel), the intermediate plate 272*a* may be formed from a non-magnetic material (e.g. anodized aluminum), and the self-biased movable valve members 244*a* and 258*a* may be formed from a magnetic material (e.g. magnetic stainless steel). A magnet 310 may be connected to the end plates 268*a* and 270*a* by conductors 312 such as iron plates. The magnet 310 may be a permanent magnet or an electromagnet, and the connection may be a permanent connection or a connection that may selectively connected and disconnected. The magnetic field, which is diagrammatically shown with arrows, will tend to hold the valve members 244*a* and 258*a* against the end plates 268*a* and 270*a* to complete the magnetic circuit because there is no path through the intermediate plate 272*a*. In those instances where the control rod 254*a* is being used to decrease the distance between the intake valve member members 244*a* and the plate 268*a*, the control rod will be part of the magnetic circuit. In those instances where an electromagnet is employed, the intensity of the magnetic field may be varied by varying the current to the electromagnet.

In at least some implementations of the valve assembly 206*a*, the magnet 310 will be thermally insulated from associated the piston and cylinder assembly. This may be accomplished by simply locating the magnet a suitable distance from the piston and cylinder assembly and connecting the valve plates to the magnet with iron bars or plates (not shown). It should also be noted that in valve assemblies which do not include the illustrated plate arrangement may simply include magnetized surfaces that function in the same manner as the end plates 268*a* and 270*a*.

As alluded to above, the protrusion that is used to open the intake valves, or close the exhaust valves, may be carried the valves themselves instead of the pistons. One example of such a valve is the intake valve 238*b* illustrated in FIG. 29. Intake valve 238*b* is substantially similar to intake valve 238 and similar elements are represented by similar reference numerals. Here, however, a protrusion 313 is carried by the movable valve member 244. The exemplary protrusion 313 includes a shaft 314 and a head 316, and may secured to the valve member 244 with a pair of connectors 318. Another example of such a valve is the exhaust valve 240*b* illustrated in FIG. 30. Exhaust valve 240*b* is substantially similar to exhaust valve 240 and similar elements are represented by similar reference numerals. Here, however, a protrusion 320 extends through the aperture 266 the in end plate 268. The exemplary protrusion 320 includes a shaft 322 and a head 324 that prevents the protrusion from falling through the end plate 268. In other implementations, a protrusion may be secured to the exhaust valve movable member 258 in, for example, the manner illustrated in FIG. 29. Another exhaust valve with a protrusion is the exhaust valve 240*c* illustrated in FIG. 31. Here, the protrusion 336 is in the form of a spring that is secured to the movable member 258. In other implementations, a head similar to head 324 may be secured to the protrusion 236 to prevent the protrusion from falling through the valve plate 268. In these implementations, the protrusion closes or partially closes exhaust valve 240B prior to the opening of intake valve 238B so as to reduce the amount of blow by losses.

Figure 33:
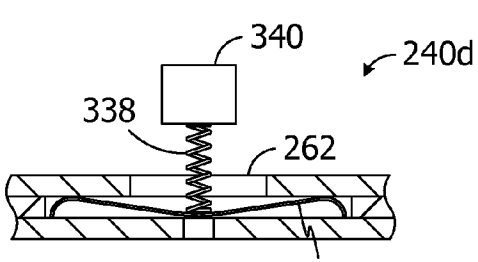
FIG. 33 is a section view of the valve illustrated in FIG. 33 in the open state.
Figure 32:
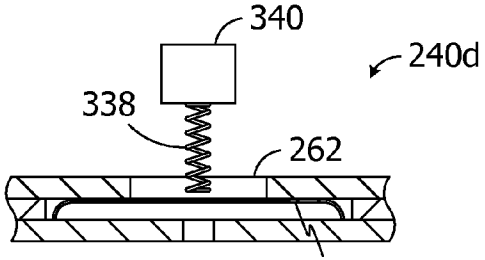
FIG. 32 is a section view of a valve in accordance with one embodiment of a present invention in a closed state.

An exhaust valve that may be selectively biased to the open or closed state is generally represented by reference numeral 240*d* in FIGS. 32 and 33. Exhaust valve 240*d* is substantially similar to exhaust valve 240 and similar elements are represented by similar reference numerals. Here, however, the movable valve member is self-biased to closed orientation illustrated in FIG. 32. A spring 338 or other resilient structure is carried by a carrier 340 that is movable from the position illustrated in FIG. 32, where the exhaust valve is biased to the closed position, to the position illustrated in FIG. 33, where the spring overcomes the self-biasing force of the movable valve member 258*d* and biases the exhaust valve 240*d* to the open state. The biasing force associated with the spring 338 may be such that, when opposed by the self-biasing force associated with the valve member 258*d*, the valve member will be biased to the opened state with substantially the same force as the above described valve member 258.

The exemplary exhaust valve 240*d* is useful in those applications where the underlying energy conversion device is sometimes run in reverse, to convert mechanical work into a compressed gas stream, during which time the exhaust valve is actually used as an intake valve. Automotive and other applications where regenerative braking is employed are examples of applications where mechanical work is converted into a compressed gas stream by one of the present energy conversion devices running in reverse.

As noted above, movable valve members in accordance with the present inventions need not be self-biased. One example of a valve assembly including movable valve members and separate biasing elements is the valve assembly 204*e* illustrated in FIG. 34. The valve assembly 204*e* has inlet and exhaust valves 238*e* and 240*e* that respectively include housings 242*e* and 256*e*, movable valve members 224*e* and 258*e*, valve seats 342 and 344, and biasing elements 346 and 348. The housings 242*e* and 256*e*, which include inlets 246*e* and 260*e* and ports 248*e* and 262*e*, are formed by end plates 268*e* and 270*e* and intermediate plate 272*e*. In the illustrated embodiment, a plurality of spaced holes 349 extend from the valve seats 342 and 344 through the intermediate plate 272*e*. The intermediate plate 270*e* defines the valve member regions 250*e* and 264*e* as well as the valve seats 342 and 344. The exemplary biasing elements 346 and 348 are in the form of coil springs, and are positioned between protrusions 350 and 352 and the movable valve members 224*e* and 258*e* to bias the valve members to the open position in spaced relation to the valve seats 342 and 344. The intake valve 238*e* also includes a protrusion 356 carried by the movable member 244*e* that may be used to open the intake valve in the manner described above, as well as a control rod 254 that may be used to adjust the distance between the movable member 244*e* and the valve seat 342 in the manner described above.

The inlet and exhaust valves 238*e* and 240*e* are configured to close in response to flow-based vacuum forces in the manner described above. Briefly, when an intake valve 238*e* is in the open state, compressed gas enters the valve by way of the inlets 246*e* and flows through the valve member region 250*e*, past the movable valve member 244*e* and through the outlet 248*e* to the associated piston chamber. The intake valve 238*e* will slam closed when the vacuum force created by the compressed gas flowing through the outlet 248*e* overcomes the biasing force associated with the biasing element 346. Here, the movable valve member 244*e* will move into contact with the valve seat 342, thereby preventing flow through the outlet 248*e*. The pressure of the compressed gas within the valve inlets 246*e* and valve member region 250*e* will prevent the biasing element 346 from moving the movable valve member 244*e* to the open state until the associated piston strikes the protrusion 356. Similarly, when an exhaust valve 240*e* is in the open state, expanded gas from the associated chamber enters the valve by way of the inlets 260*e*, flows through the valve member region 264*e* past the movable valve member 258*e* and through the outlet 262*e*. The exhaust valve 240*e* will slam closed when the vacuum force created by the expanded gas flowing through the outlet 262*e* overcomes the biasing force associated with the biasing element 348. The movable valve member 258*e* will move into contact with the valve seat 344, thereby preventing flow through the outlet 262*e*.

Figure 35:
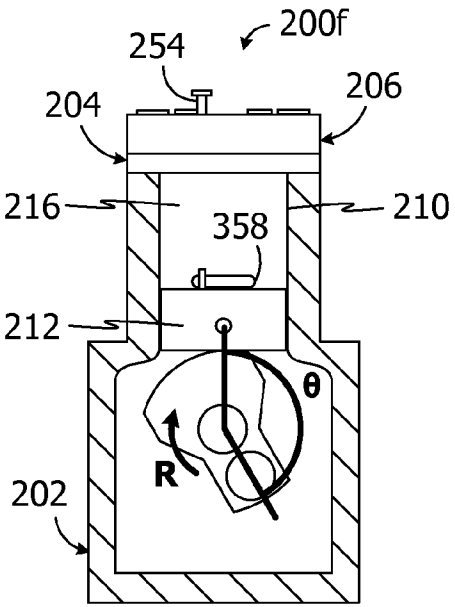
FIG. 35 is a side, partial section view of an energy conversion device in accordance with one embodiment of a present invention.

The piston and cylinder assemblies associated with the present energy conversion devices are also susceptible to a many variations from that described above. For example, in the exemplary energy conversion device 200*f* illustrated in FIG. 35, which is otherwise identical to the energy conversion device 200, the cylinders 210 are each provided with an exhaust port 358 that vents to ambient or to the outlet portion of the associated manifold. The cylinder exhaust port 358, which is uncovered by the piston 212 near the end of the expansion stroke, increases peak torque and substantially reduces the likelihood that the energy conversion device will stall, but reduces the displacement of the energy conversion device. For example, cylinder exhaust port that is 10 mm long (measured in the throw direction) will reduce the displacement of a piston with a 50 mm throw by 20%. The area of the cylinder exhaust port 358 is determines how much the peak horsepower will be increased by the presence of the cylinder exhaust port. It should also be noted that cylinder exhaust ports that are relatively short (in the throw direction) and wide, as shown in FIG. 35, provide superior performance. Alternatively, instead of a single relatively short port, a plurality of relatively short ports may be spaced around the cylinder. Additionally, in at least some implementations, the exhaust valve (e.g. exhaust valve 240) may be omitted from energy conversion devices that include a cylinder exhaust port.

The control rods, as well as the other devices describe above that control the operation of the intake valves and/or exhaust valves, may be used to cause energy conversion devices in accordance with the present inventions, including those described above and below, to operate in different modes. Thus, although the modes are discussed with reference to the exemplary energy conversion device 200*f* (FIG. 35), the discussion of the modes are applicable to some or all of the other energy conversion devices. In each of the modes described below, gas is being supplied to the energy conversion device at the same pressure.

Referring to FIG. 35, an exemplary first operating mode is a relatively high efficiency, high speed, low torque (in those instances where the piston is connected to a rotating shaft by a mechanical linkage) mode that facilitates torque control. The first mode has application in, for example, stationary energy conversions devices (e.g. those associated with generators) and automobile engines when running at a relatively constant speed and a relatively low torque. The first operating mode is set by moving the control rod 254 to a position that prevents the intake valve members from reaching their fully open position (note FIG. 17) and will result in the intake valves 238 closing during the expansion stroke when θ is about 10-30 degrees.

In a second exemplary operating mode, the control rod 254 will be moved up (in the illustrated orientation) from the position associated with the first mode, although the control rod is still acting on the movable valve member 244. The area under the intake valve movable members 244 will be greater than in the first mode, so the intake valve 238 will close later in the expansion stroke, e.g. when θ is about 50-80 degrees. The gas is not complete expanded by the time the piston 212 passes the exhaust port 358. Some gas will be lost as the piston 212 passes the exhaust port 358. As compared to the first mode, the second mode is a lower speed, higher torque and lower efficiency mode. The second mode has application in, for example, automobile engines when accelerating.

The third exemplary operating mode is higher in toque and lower in speed than the second operating mode. It is also represents the maximum power output for a given inlet pressure and has application in, for example, automobile acceleration. The control rod 254 will be moved up (in the illustrated orientation) from the position associated with the second mode to a position where it will no longer provide any control authority. The piston 212 will travel through essentially the entire expansion stroke without the intake valve 238 closing. The intake valve 238 will close when the piston 212 passes the exhaust port 358 and the compressed gas is released. The power output is close to $(P_I-P_O)\times V_C$. Although the torque of energy conversion device may not be directly controlled in the third mode, the energy conversion device will produce torque at very low speed and, therefore, will be difficult to stall.

Figure 34:
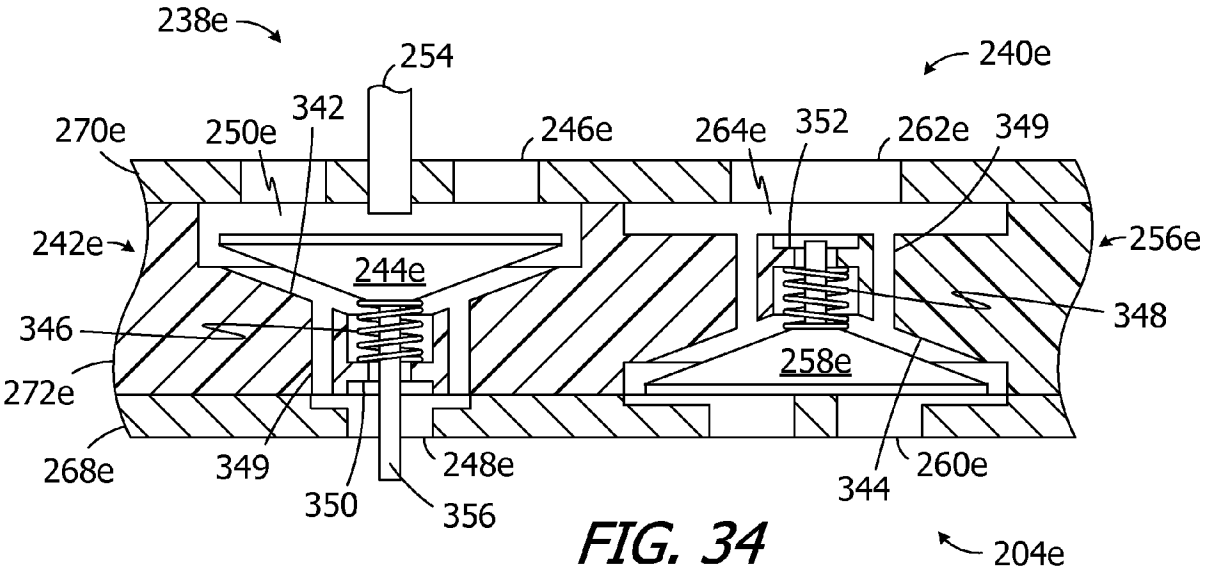
FIG. 34 is a section view of a valve assembly in accordance with one embodiment of a present invention.
Figure 34A:
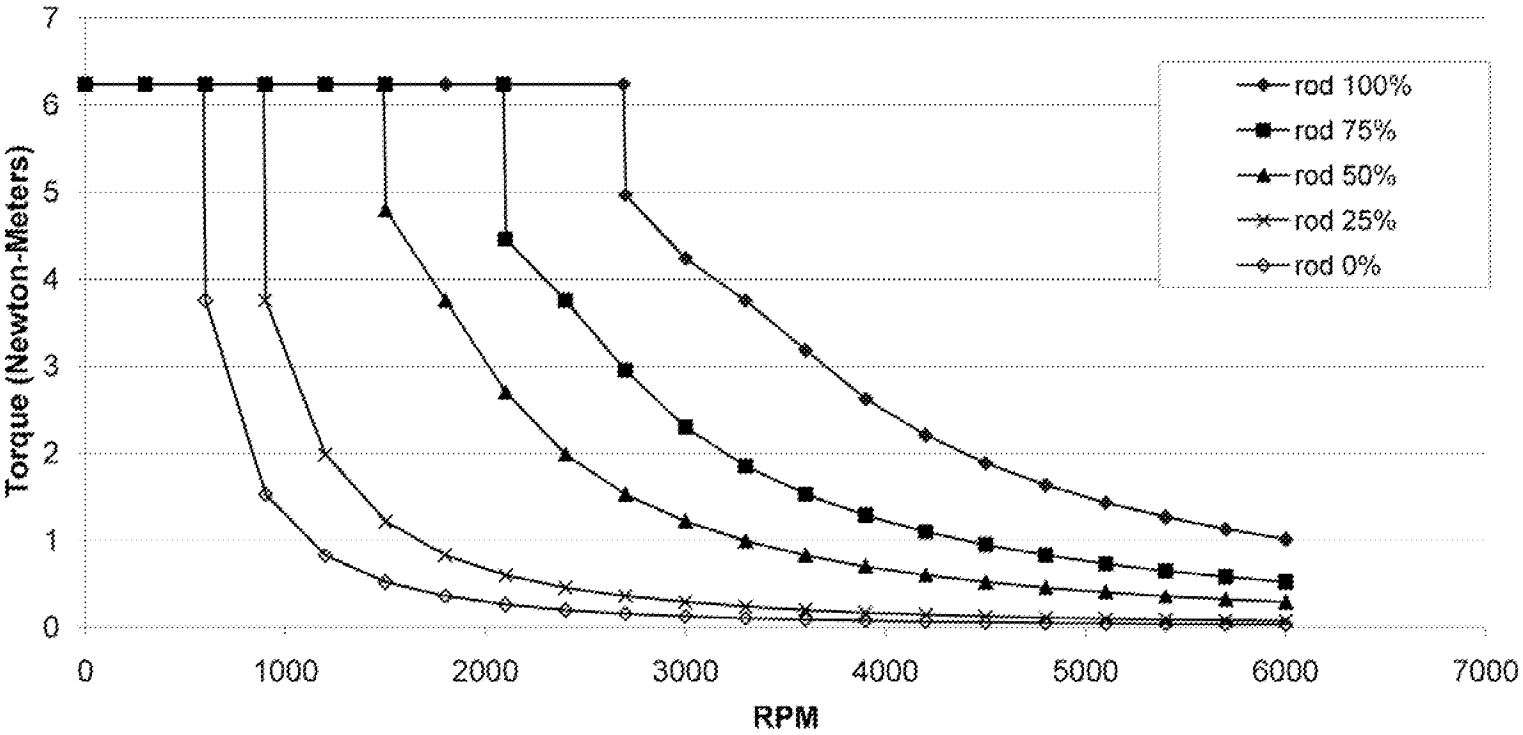
FIG. 34*a* is a torque vs RPM graph in accordance with one embodiment of a present invention.
Figure 36:
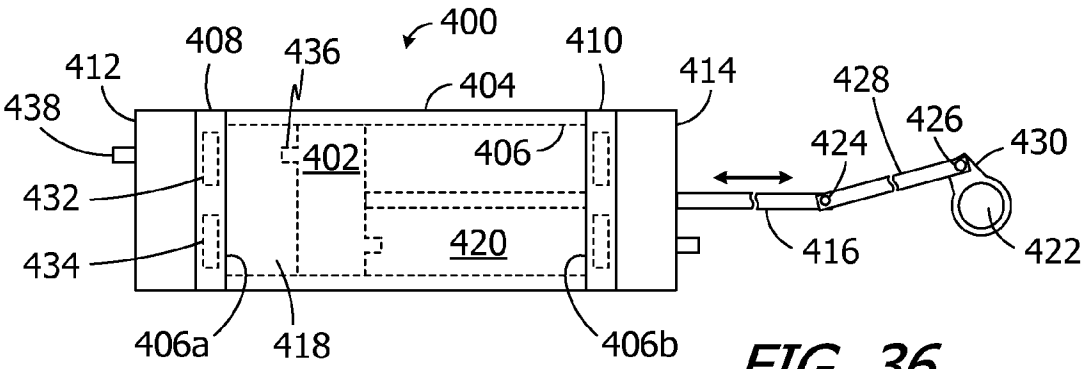
FIG. 36 is a side view of an energy conversion device in accordance with one embodiment of a present invention.

FIG. 34*a* is a graph showing torque versus energy conversion device speed (RPM) and control rod position in an exemplary 50 cc energy conversion device. In the illustrated graph, the position of the control rod 254 is represented in terms its fully retracted position. The fully retracted position, i.e. the position where the control rod 254 will not come into contact with the movable valve element, is represented by 100%. The fully deployed position, i.e. the position where the control rod 254 is just above the highest point of the piston protrusion 236 (in the orientation illustrated in FIG. 27A), is represented by 0%. From the graph, it can be seen that over a range of speeds, torque can be controlled with the control rod 254, and as the control rod is moved to the fully retracted position, the energy conversion device transitions from first operating mode to second operating mode to third operating mode. From the graph, it can also be seen that as speed decreases and the control rod 254 remains in remains in the same place, the energy conversion device transitions from the first operating mode to second operating mode to third operating mode and torque increases.

In the fourth exemplary operating mode, the energy conversion device is operating in reverse, i.e. is operating as a compressor, with mechanical work supplied by way of the crankshaft being used to drive the piston 212. In those applications where the fourth operating mode will be used (e.g. automobiles or other vehicles with regenerative braking), the exhaust valve should be a valve such as the exemplary exhaust valve 240*d* (FIGS. 32 and 33) that may be biased to both the open and closed positions. The exhaust valve 240*d* will be biased to the closed position, so that it operates as a check valve, and will open as the piston 212 moves through the expansion stroke in the fourth mode. Uncompressed gas will be drawn into the cylinder 216 and then compressed during the return stroke. The compressed gas will exit the energy conversion device by way of the intake valve, which will also now operate like a check valve, for storage and subsequent use. Total braking torque can be adjusted by varying the position of the control rod 254 to allow more gas from the intake valve 238 to enter the cylinder 216 on the expansion stroke.

It should also be noted that when the fourth operating mode is actuated in a high pressure steam system with extra liquid water in the radiator (exhaust stream) and extra volume and heat capacity in the boiler or pre-boiler area itself, steam from the radiator will be pumped back to the intake stream. Water in the radiator will boil to create more steam to pump, and the high pressure steam will condense in the boiler or pre-boiler area making room for more steam. Heat is effectively being pumped from the liquid water in the radiator into the boiler or pre-boiler area. The total regenerative braking requirements of a typical automobile car can be met with a few liters of liquid water in the radiator plus a few kilograms of extra mass in the high pressure steam system heat capacity. The stored heat and high pressure steam will be returned to the energy conversion device when the vehicle accelerates again after a stop at reasonably high efficiency. The needs of such a system are relatively modest as compared with those of a gasoline-electric hybrid regenerative braking system.

Energy conversion devices in accordance with the present inventions may be started in a variety of ways. Various startup methods are described below by way of example, but not limitation, with reference to energy conversion devices that includes a rotating crankshaft. For example, the energy conversion device may be pre-heated by passing gas (e.g. steam) through open inlet and exhaust valves at an initially low flow rate and then increasing the flow rate to a startup flow rate that causes the intake valves to slam closed. In some instances, the startup flow rate may be about 15 times the average operating flow rate for an energy conversion device set to operate in a mode where the intake valve(s) close when θ is about 45 degrees due to the high gas velocity required to close the intake valve. Also, when operating, the energy conversion device will require this same peak flow rate and the pipes that feed the energy conversion device must be sized accordingly. For example, in steam-based system, the boiler may be oversized as compared to the size required for operation, or a starter valve that can be shut until the boiler reaches startup pressure may be provided upstream of the intake valves. Alternately, the control rod 254 may be lowered as much as is practicable to minimize the flow rate necessary to close the intake valves. A starter motor (not shown) may then be used to bring the crankshaft 214 up to speed required for energy conversion device to start. Alternately, the starter motor may be engaged before the intake pressure is applied.

Energy conversion devices in accordance with the present inventions are not limited to those in which the piston is connected to a crank shaft in the manner illustrated in FIG. 6. The energy conversion device 400 illustrated in FIG. 36, for example, includes a double-acting piston and a linearly moving output shaft. More specifically, the energy conversion device 400 includes a piston 402, a block 404 with a cylinder 406 that is open at first and second ends 406*a* and 406*b*, first and second valve assemblies 408 and 410, and first and second manifolds 412 and 414. A linearly movable output shaft 416 is secured to the piston 402 and extends through second valve assembly 410. Chambers 418 and 420, which vary in volume as the piston 402 moves back and forth, are defined between the piston and the valve assemblies 408 and 410. The shaft 416 may be used to connect the energy conversion device 400 to any suitable apparatus. In the illustrated example, the linearly movable shaft 416 is connected to a rotating shaft 422, by a pair of bearings 424 and 426, a connecting rod 428, a rod journal 430.

The exemplary first and second valve assemblies 408 and 410 and manifolds 412 and 414 may be configured in any of the manners described above and below and, in the illustrated implementation are configured in the manner described above with reference to exemplary valve assembly 204. For example, the first and second valve assemblies 408 and 410 each include inlet and exhaust valves 432 and 434 that are configured in the manner described in conjunction with to valves 238 and 240. To that end, the piston 402 carries a pair of protrusions 436 that are used to open the intake valves, and a pair of control rods 438 are used to limit the travel of the movable valve members in the intake valves in the manner described above. The second valve assembly 410 and manifold 414 must, however, include apertures for the output shaft 416 with appropriated gas-tight seals.

The energy conversion device 400 operates in a manner similar to the energy conversion device 200. Here, however, the work output is doubled because an expansion stroke is always occurring. The expansion and compression strokes associated with the valve assembly 408 and chamber 418 are 180 degrees out of phase with the expansion and compression strokes associated with the valve assembly 410 and chamber 420. It should also be noted that, in other implementations, the piston 402 may be used to drive two separate output shafts in opposite directions.

Figure 37:
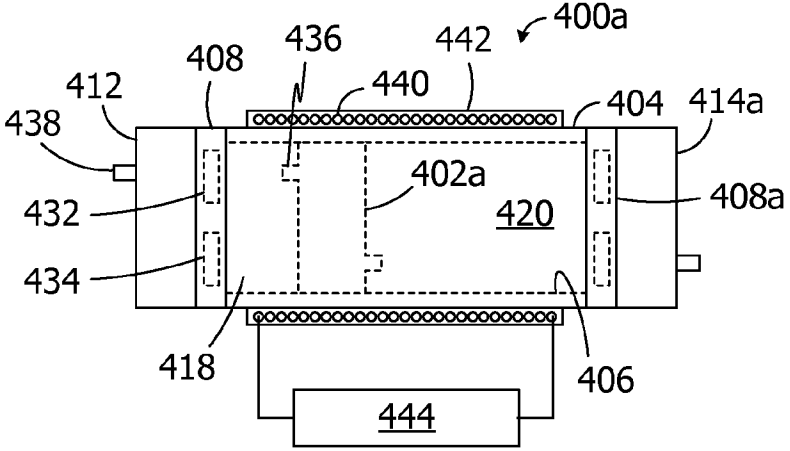
FIG. 37 is a side, partial section view of an energy conversion device in accordance with one embodiment of a present invention.

Another exemplary energy conversion device is the sealed energy conversion device 400*a* illustrated in FIG. 37. The energy conversion device 400*a* is substantially similar to the energy conversion device 400 and similar elements are represented by similar reference numerals. Here, however, the compressed gas stream is converted directly into electricity, as opposed being used to, for example, drive a separate electrical generator. To that end, the piston 402*a* is formed from a magnet and one or more coils 440 are carried outside the cylinder 406 in electrically insulating material 442. Movement of the magnetic field associated with the piston 402*a* causes current to be induced in the coil(s) 440. The coil(s) 440 may be connected to an electrical device or system 444 that stores and/or consumes the electrical power generated by movement of the piston 402*a*. The coil(s) 440 may also be used to get the piston 402*a* moving during startup.

The energy conversion device 400*a* does not include an output shaft and, accordingly, may be sealed but for the manifold inlets and outlets. The second valve assembly 410*a* and manifold 414*a* do not include apertures for an output shaft and may be identical to the first valve assembly 408 and manifold 412. Although the energy conversion device 400*a* may be employed in any suitable application, the sealed aspect makes the energy conversion device particularly useful in high RPM and refrigerant-based systems. For example, the energy conversion device 400*a* could be used in place of the expander in a refrigeration system. High pressure refrigerant will may supplied to the chambers 418 and 420 by way of the intake valves 432, while lower pressure refrigerant and some liquid will exit the chambers by way of the exhaust valves 434. The construction is similar to a modern Stirling engine.

Figure 38:
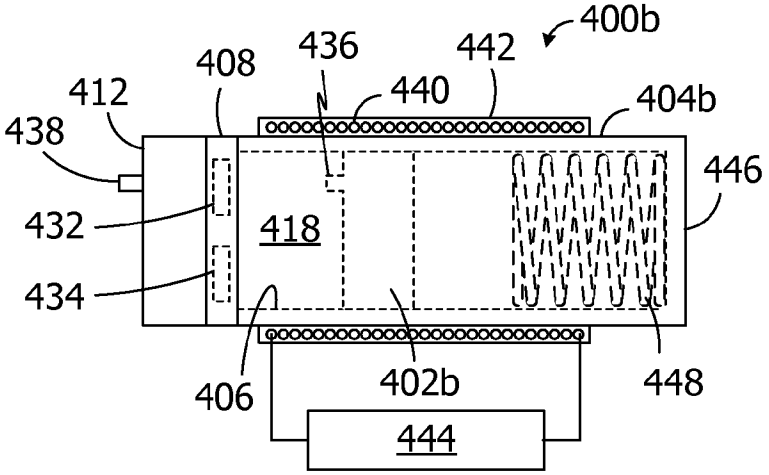
FIG. 38 is a side, partial section view of an energy conversion device in accordance with one embodiment of a present invention.

Another exemplary energy conversion device is generally represented by reference numeral 400*b* in FIG. 38. The energy conversion device 400*b* is substantially similar to the energy conversion device 400 and similar elements are represented by similar reference numerals. Here, however, the energy conversion device is a single-acting device and the block 404*b* is configured such that one end of the cylinder 406 is sealed by a wall 446. Energy for the return stroke is provided by a spring 448. The magnetic piston 402*b* includes a single protrusion 436. The wall 446 may be sealed, or may be connected to the exhaust manifold through a connection (not shown) in order to pass condensed water or oil that may build up on that side of the piston 402*b*.

Figure 39:
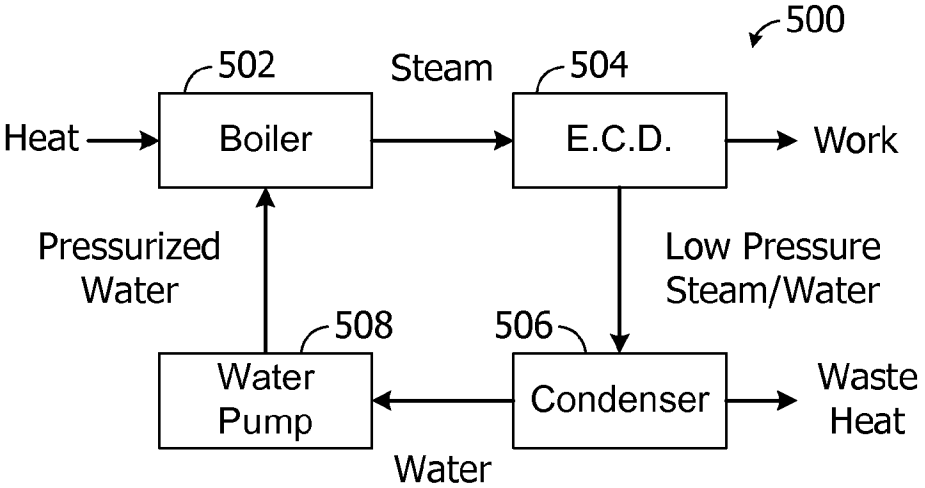
FIG. 39 is a block diagram of a system in accordance with one embodiment of a present invention.

The present energy conversion devices may be employed in a wide variety of systems. Such systems include, but are not limited to, the systems illustrated in FIGS. 39-44B. Referring first to FIG. 39, an exemplary steam-based system 500 includes a boiler 502, an energy conversion device 504, a condenser 506 and a water pump 508. Suitable boilers include, but are not limited to, oil, natural gas, solar, and propane powered boilers. The energy conversion device 504 may be any of the energy conversion devices described above. Liquid water or a liquid high temperature refrigerant is converted into stream of high pressure gas (i.e. steam) by the boiler 502, and the energy conversion device converts the high pressure gas stream into mechanical work and then possibly to electrical power. Low pressure steam and some liquid water exit the energy conversion device 504 and the steam is converted into liquid water at the condenser 508. The liquid water is returned to the boiler by way of the pump 508.

Figure 40:
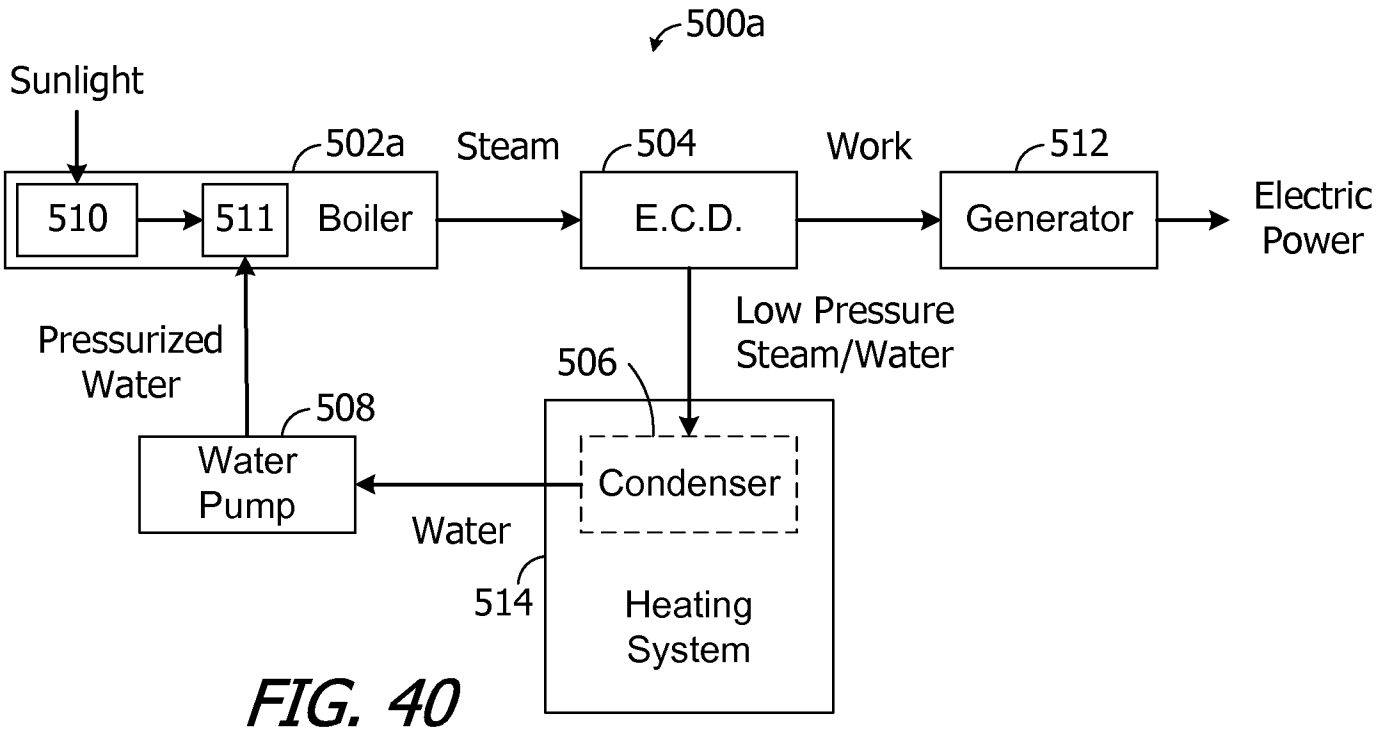
FIG. 40 is a block diagram of a system in accordance with one embodiment of a present invention.
Figure 41:
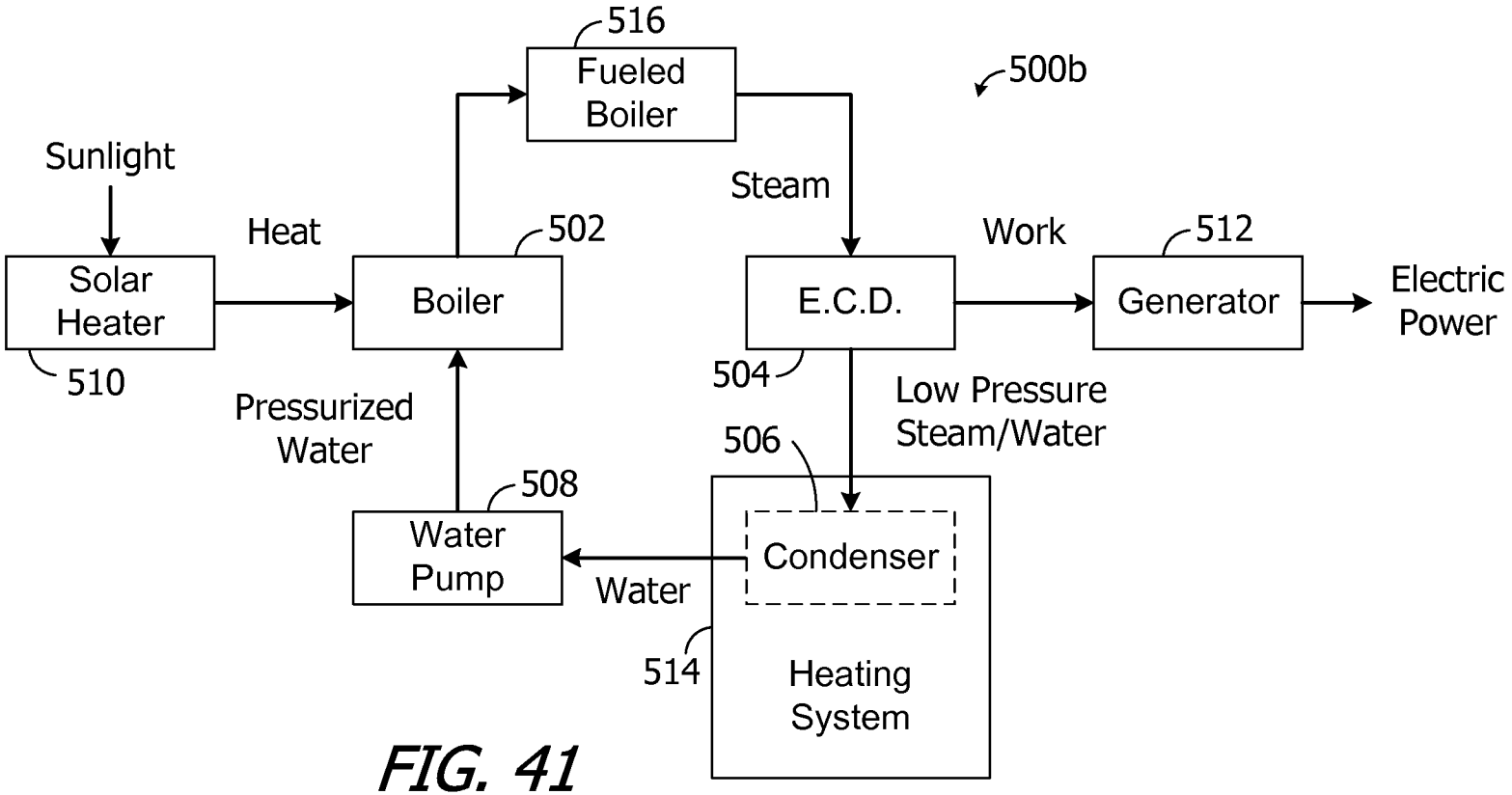
FIG. 41 is a block diagram of a system in accordance with one embodiment of a present invention.

Turning to FIG. 40, another exemplary steam-based system 500*a* is the illustrated solar power generation and heating system. Such a system may be used to provide power (e.g. 1-20 kilowatts) and heat to, for example, a home or business. The system includes a solar powered boiler 502*a*, an energy conversion device 504, a condenser 506 and a water pump 508 that together operate in the manner described above. The mechanical work output of the energy conversion device 504 is used to drive an electrical generator 512 and waste heat associated with the condenser 506 may be used by a heating system 514 for space or water heating, as is described below.

With respect to the solar powered boiler 502*a*, one exemplary implementation is as follows. A reflector 510, such as a nominally parabolic trench-shaped reflector, or a Fresnel approximation of the same, focuses sunlight onto a small collector 511. A sun tracker and motor arrangement (not shown) orients and reorients the reflector so that sunlight remains focused thereon as the sun moves across the sky. The collector may be dark or black to the visible light spectrum, may be partially reflective to infrared light to reduce heat loss, and may be surrounded by a glass envelope containing vacuum to insulate it from wind. The collector brings in heat at about 200° C. to the pressurized water from the pump 508. The water boils to make steam, which is much larger in volume than the water and is fed to the energy conversion device 504.

Turning to the generator 512, the generator may be an AC generator that pumps AC power directly into an AC grid, or can be DC generator that feeds an inverter which pumps AC power into the AC grid. This power may be fed into the grid downstream from the usage meter, which will make the meter run in reverse, thereby reducing the amount of energy that the home or business consumer will have to pay for.

Additionally, the waste heat associated with the condenser 506 may be used by a heating system 514 for space or water heating. The condenser 506 is where heat is transferred. Steam enters the condenser 506 and liquid water exits. For example, the condenser 506 may be in the form of a heat pipe in which steam travels upwardly and condensed water comes back down due to gravity. The condenser 506 may be surrounded by water within a water heater tank. The condenser 506 may be part of a home heater, such as radiator without a fan that radiates heat into a house or a heater that has a fan which blows over the condensor. The condenser may also be used as a pool heater. Here, the condenser may be in the form of a copper pipe (with steam in it) that is soldered to a water pipe from the pool pump over a short length. Heat is transferred by way of the solder connection.

Figure 42:
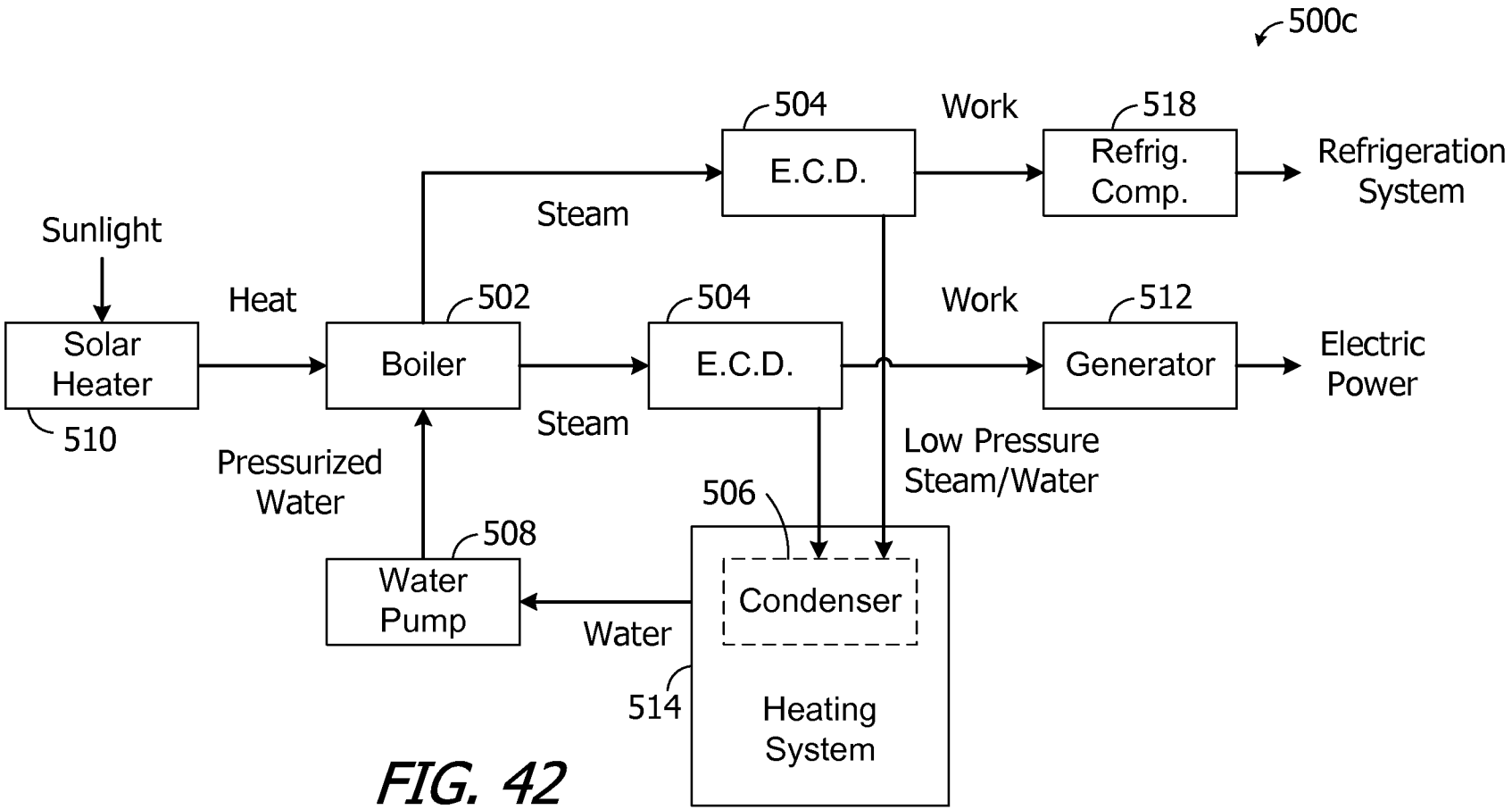
FIG. 42 is a block diagram of a system in accordance with one embodiment of a present invention.

Solar heating systems may also be provided with a fuel consuming boiler, such as a natural gas or propane fueled boiler, for use at night and cloudy days. One example of such a system is generally represented by reference numeral 500*b* in FIG. 41. System 500*b* is identical to system 500*a* but for the addition of a fuel consuming boiler 516. Alternatively, or in addition, a refrigeration compressor may be added to a solar heating system to offload the primary compressor in a refrigeration system. Alternately, a water pump may be substituted for the refrigeration compressor to offload an electric water pump. To that end, the exemplary system 500*c* illustrated in FIG. 42 is identical to system 500*a* but for the addition of a second energy conversion device 504 and a refrigeration compressor or pump 518 that is driven by the work output of the second energy conversion device.

Figure 43:
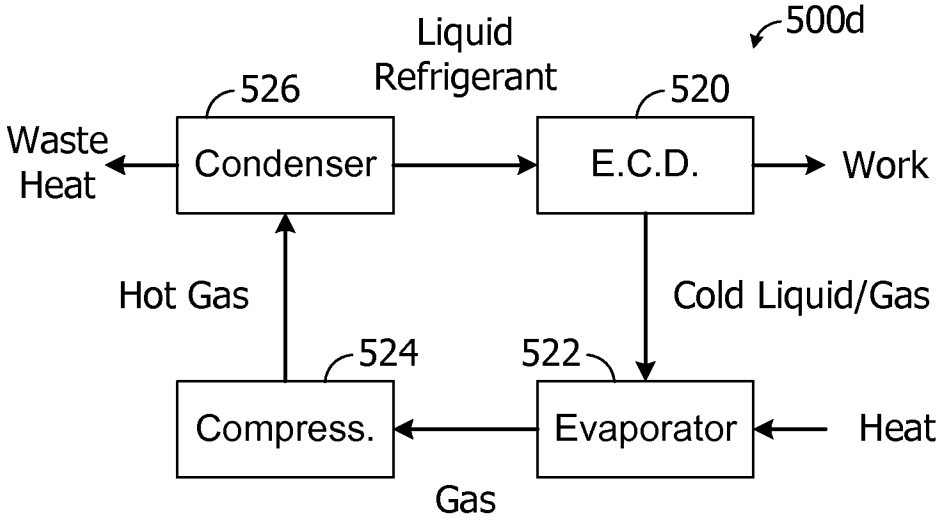
FIG. 43 is a block diagram of a system in accordance with one embodiment of a present invention.

An exemplary refrigeration system, which is generally represented by reference numeral 500*d* in FIG. 43, includes an energy conversion device 520, an evaporator 522, a compressor 524 and a condenser 526. The energy conversion device 520, which may be one of the closed energy conversion devices described above with reference to FIGS. 37 and 38, takes the place of the expansion valve found in conventional refrigeration systems. The refrigeration cycle associated with the system 500*d* proceeds in the conventional manner. Liquid refrigerant from the condenser 526 is supplied to the energy conversion device 520, which produces mechanical work. Cold liquid and gas refrigerant flow from the energy conversion device 520 to the evaporator 522, where heat is added. The resulting gas refrigerant is returned by the compressor 524 to the condenser 526 at a higher temperature. Here, however, the high pressure gas associated with the flash evaporation liquid refrigerant is used to drive one of the present energy conversion devices (e.g. device 400*a* in FIG. 37), which increases the overall efficiency of the system. Efficiency is increased, as compared to a conventional refrigeration system, by removing energy which an expansion valve in a conventional refrigeration system would have delivered as heat into the evaporator.

Figure 44A:
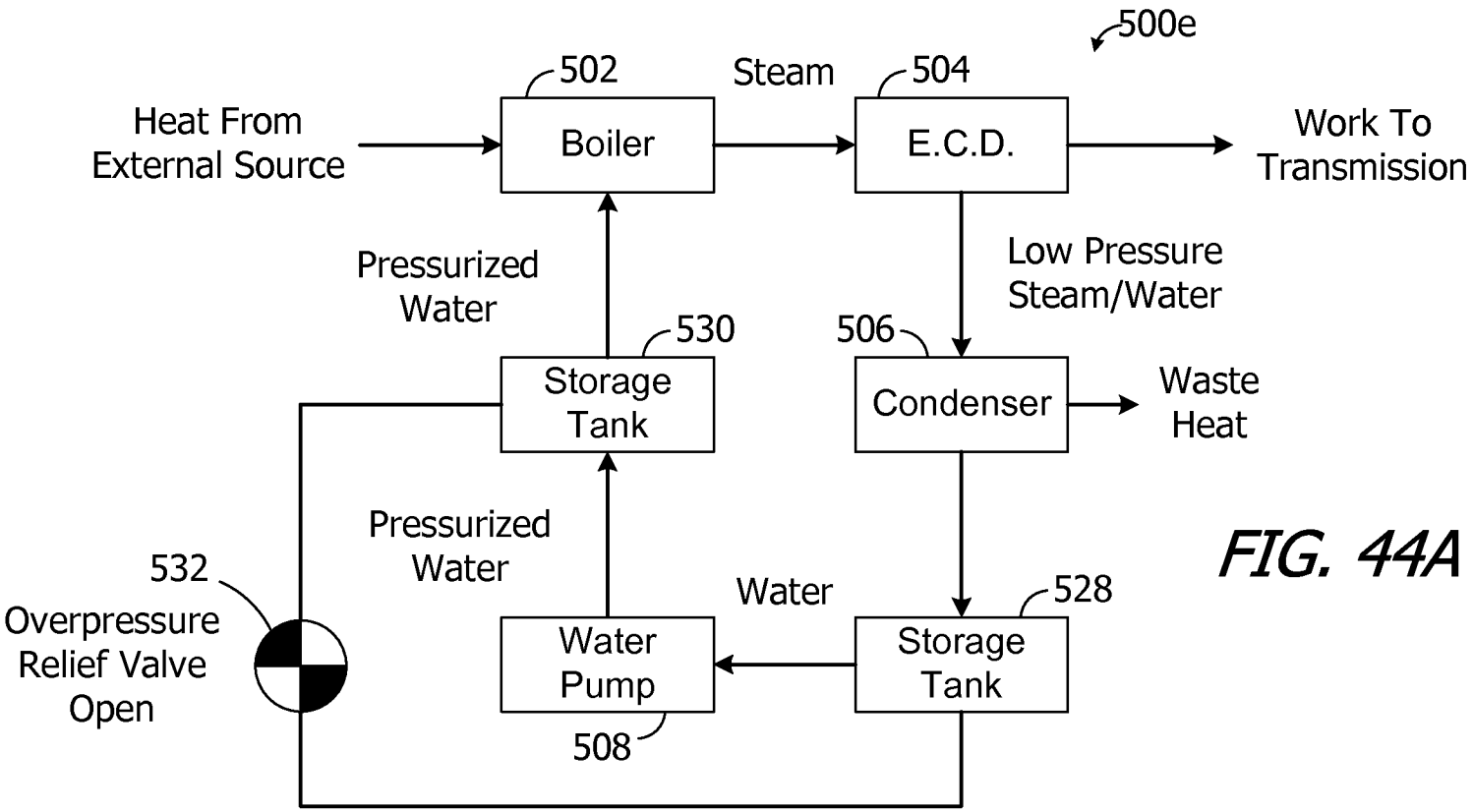
FIGS. 44A and 44B are block diagrams of a system in accordance with one embodiment of a present invention.
Figure 44B:
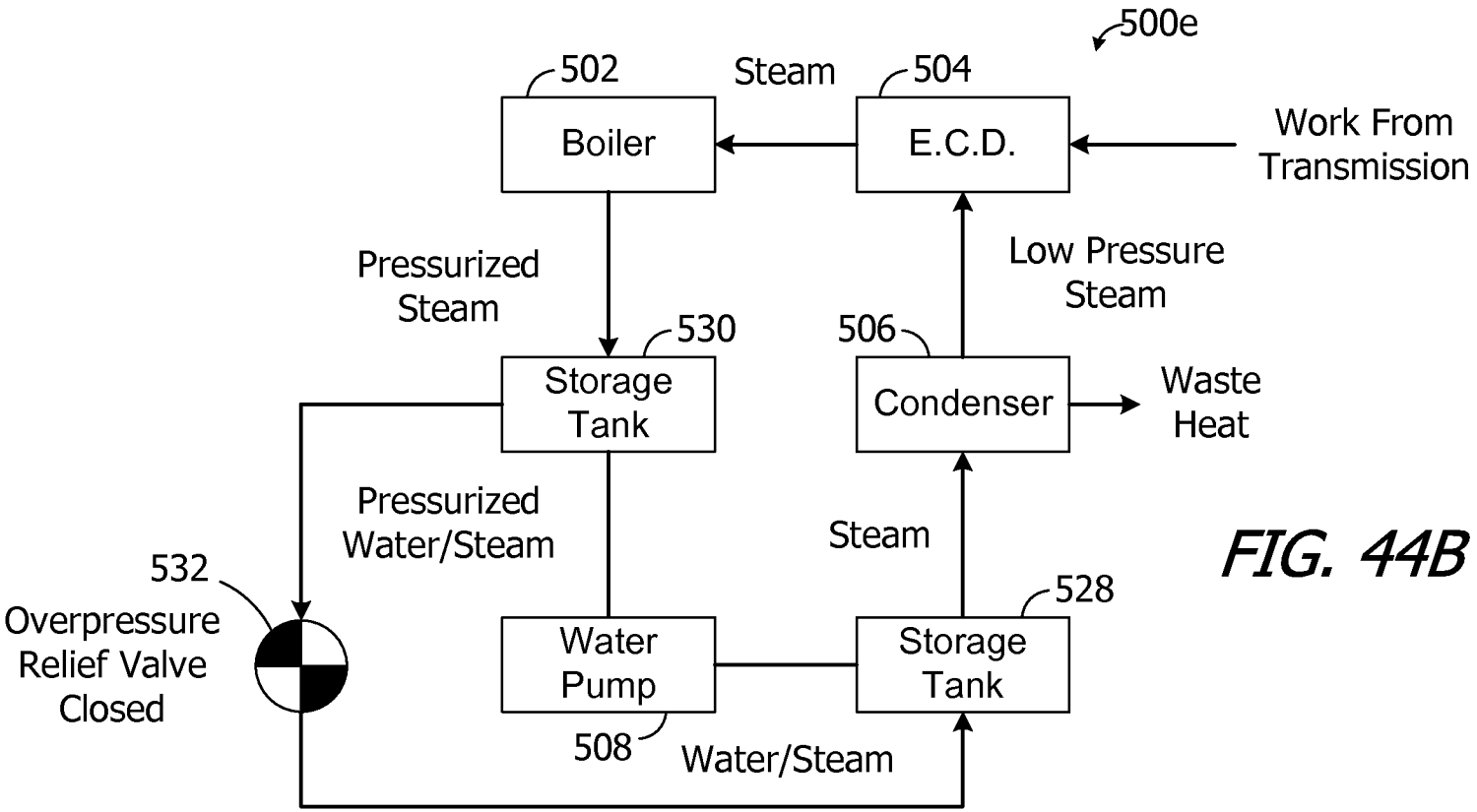

An exemplary automotive power plant is generally represented by reference numeral 500*e* in FIGS. 44A and 44B. The automotive power plant may serve as a replacement for a gasoline engine and may be connected to the vehicle transmission in the same way. FIG. 44A shows the system delivering power to the transmission, such as during driving. FIG. 44B shows the system receiving energy from the transmission, such as during braking.

The exemplary power plant 500*e* consists of a boiler 502, an energy conversion device 504, a condenser 506, storage tanks 528 and 530, a water pump 508, and an overpressure relief valve 532. The energy conversion device 504 may employ a control rod, such as the control rod 126 describe above with reference to FIG. 4, to control torque and an exhaust valve, such as the exhaust valve 240*d* describe above with reference to FIGS. 32 and 33, to enable regenerative braking. The energy conversion device 504 may also include an exhaust port, such as the exhaust port 358 describe above with reference to FIG. 35 to enable greater torque. The boiler 502 may consist of a single structure, or may consist of multiple structures to accommodate heat flow from different sources, and may be larger and heavier than might be necessary to power the vehicle in order to absorb energy during regenerative braking. The storage tank 530 may simply be the pipe extending between the boiler 502 and water pump 508, or may be a larger heavier vessel connected to the boiler and the water pump by pipes. In some applications, the overpressure relief valve 532 may be contained within water pump 508, or may simply be a characteristic of the water pump which would allow water to flow backwards when subjected to overpressure. The storage tank 528 may be a separate vessel or may be an area of liquid within condenser 506.

Referring more specifically to FIG. 44A, which shows the power plant 500*e* delivering power to the vehicle transmission, heat is added to the boiler 502 from an external source to convert pressurized water into steam. The external source may be a heat storage system, a combustion-based heater or catalytic-based heater. Heat flow is regulated to produce the desired volume, temperature, and pressure of steam. High pressure steam from the boiler 502 is delivered to the energy conversion device 504 intake valve, and the energy conversion device converts the high pressure steam to lower pressure steam plus some liquid water and produces torque to drive the transmission. The energy conversion device exhaust valve is in the open state illustrated in FIG. 33. The low pressure low temperature steam goes to the condenser 506, which rejects waste heat to ambient and converts the steam to water. The water passes through the storage tank 528 and to the pump 508 where it is converted to higher pressure water. The higher pressure water passes through the storage tank 530, which contains nominally cool but high pressure water. This water feeds the boiler 502 and completes the loop. The over pressure valve 532 is closed in this mode of operation.

Turning to FIG. 44B, when the transmission is delivering power to the energy conversion device 504 (e.g. during braking), there are three stages in which the system can absorb energy. In all of the stages, the exhaust valve of the energy conversion device 504 is in closed state illustrated in FIG. 32 and braking torque can be reduced by raising the control rod 126 (FIG. 4). In the first two stages, energy absorbed by the system 500*e* can be returned by reducing heat consumption of the boiler 502 later when the system resumes the delivery of power to the transmission (FIG. 44A). This is known as regenerative braking.

In the first stage of braking, the energy conversion device 504 pumps steam from the condenser 506 to the boiler 502. The boiler 502 has some mass and, therefore, has a specific heat. As steam is pumped into the boiler 502, the steam will condense in the boiler and raise its temperature. Pressure and temperature in the boiler will rise slowly in this stage depending on the braking energy absorbed by the energy conversion device 504 and the specific heat of the boiler. In the condenser 506, the drop in pressure caused by the steam absorbed by the energy conversion device 504 will cause water in the storage tank 528 to boil. This will make up the steam absorbed by the energy conversion device 504 and cause the pressure in the condenser to drop slowly. Braking energy in this mode is used to superheat the boiler, which will enable the energy conversion device 504 to run for some time when power delivery to the transmission is resumed (FIG. 44A) without heat having to be added to the boiler 502.

In the second stage of braking, the pressure in the boiler 502 is now high enough to open overpressure relief valve 532. Water will leave storage tank 530 and the enter tank 528. Steam will enter the tank 530 and condense on the walls of the tank as well as the liquid water within the tank. The temperature of storage tank 530 will rise as steam condenses within it. The heat delivered to storage tank 530 will subtract from heat required later by the boiler 502 when the energy conversion device 504 returns to the mode illustrated in FIG. 44A. Some heat will still be required to convert the preheated water from the storage tank 530 into steam in the boiler 502, but this is less than the amount of heat that would be required to boil water which had not been preheated. In this way, the energy absorbed by braking can be returned to the energy conversion device 504 more slowly than is the case in the first stage.

In the third stage of braking, the storage tank 530 reaches maximum temperature and the overpressure relief valve 532, which has now consumed most of the water from storage tank 530, will begin to pass high pressure steam to the storage tank 528. The energy conversion device 504 will continued to provide braking torque without damage, but the system will not be able to return this energy later. This is similar to a conventional braking system in which the kinetic energy of the vehicle is converted to heat and dissipated. The steam will heat water in tank 528, and when it is hot enough the condenser will begin passing waste heat to ambient.

Although the present inventions have been described in terms of the preferred embodiments above, numerous modifications and/or additions to the above-described preferred embodiments would be readily apparent to one skilled in the art. It is intended that the scope of the present inventions extend to all such modifications and/or additions and that the scope of the present inventions is limited solely by the claims set forth below.

I claim:

1. An energy conversion device, comprising:

a cylinder defining first and second longitudinal ends;

a piston located within the cylinder and movable relative to the cylinder;

an intake valve associated with the first longitudinal end of the cylinder and including an outlet and an intake valve member, the intake valve member being movable, between an open position in spaced relation to the outlet and a closed position that abuts the outlet, and biased to the open position by a biasing force;

a protrusion carried by the piston or the intake valve member such that the piston moves the intake valve member to the open position when the piston is adjacent to the intake valve; and an exhaust valve associated with the first longitudinal end of the cylinder and including an outlet and an exhaust valve member, the exhaust valve member being movable between an open position in spaced relation to the outlet and a closed position that abuts the outlet and biased to the open position by a biasing force;

wherein at least one of the intake valve member and the exhaust valve member comprises a resilient structure that is self-biasing and includes first and second substantially planar portions and a curved portion between the first and second substantially planar portions.

2. An energy conversion device as claimed in claim 1, wherein the intake valve is configured such that the intake valve member will move to the closed position when flow through the intake valve reaches a critical flow rate; and the exhaust valve is configured such that the exhaust valve member will move to the closed position when flow through the exhaust valve reaches a critical flow rate.

3. An energy conversion device as claimed in claim 1, wherein there is a maximum distance between the intake valve member and the outlet when the intake valve is open, the energy conversion device further comprising:

a control element movable relative to the intake valve member between a first position that prevents the intake valve member from being the maximum distance from the outlet when the intake valve is open and a second position that does not prevent the intake valve member from being the maximum distance from the outlet when the intake valve is open.

4. An energy conversion device as claimed in claim 1, wherein the protrusion is carried by the piston.

5. An energy conversion device as claimed in claim 1, wherein the protrusion is carried by the intake valve member.

6. An energy conversion device as claimed in claim 1, further comprising:

an exhaust valve closer that operably connects the piston to the exhaust valve member such that the piston moves the exhaust valve member to the closed position when the piston is adjacent to the exhaust valve.

7. An energy conversion device as claimed in claim 1, wherein the exhaust valve member is biased to the open position by a resilient member; and the resilient member is movable away from the exhaust valve member, whereby the exhaust valve member will be biased to the closed position.

8. An energy conversion device as claimed in claim 1, wherein the cylinder includes an exhaust port.

9. An energy conversion device as claimed in claim 1, wherein the intake valve defines a first intake valve, the protrusion defines a first protrusion and the exhaust valve define first exhaust valve, the energy conversion device further comprising:

a second intake valve associated with the second longitudinal end of the cylinder and including an outlet and an intake valve member, the intake valve member being movable between an open position in spaced relation to the outlet and a closed position that abuts the outlet and biased to the open position by a biasing force;

a second protrusion carried by the piston or the intake valve member of the second intake valve such that the piston moves the intake valve member of the second intake valve to the open position when the piston is adjacent to the second intake valve; and a second exhaust valve associated with the second longitudinal end of the cylinder and including an outlet and an exhaust valve member, the second exhaust valve member being movable between an open position in spaced relation to the outlet and a closed position that abuts the outlet and biased to the open position by a biasing force.

10. An energy conversion device as claimed in claim 9, further comprising:

a linearly movable output shaft connected to the piston.

11. An energy conversion device as claimed in claim 9, wherein the piston comprises a magnet, the energy conversion device further comprising at least one coil that extends around the cylinder.

12. An energy conversion device as claimed in claim 1, wherein the piston is operably connected to a crankshaft.

13. An energy conversion device as claimed in claim 1, wherein the cylinder comprises a plurality of cylinders;

the piston comprises a plurality of pistons respectively located within the plurality of cylinders;

the intake valve comprises a plurality of intake valves respectively associated with the plurality of cylinders;

the protrusion comprises a plurality of protrusions respectively carried by the plurality of pistons; and the exhaust valve comprises a plurality of exhaust valves respectively associated with the plurality of cylinders.

14. An energy conversion device comprising:

a cylinder defining first and second longitudinal ends;

a piston located within the cylinder and movable relative to the cylinder;

an intake valve associated with the first longitudinal end of the cylinder and including an outlet and an intake valve member, the intake valve member being movable, between an open position in spaced relation to the outlet and a closed position that abuts the outlet, and biased to the open position by a biasing force;

a protrusion carried by the piston or the intake valve member such that the piston moves the intake valve member to the open position when the piston is adjacent to the intake valve; and an exhaust valve associated with the first longitudinal end of the cylinder and including an outlet and an exhaust valve member, the exhaust valve member being movable between an open position in spaced relation to the outlet and a closed position that abuts the outlet and biased to the open position by a biasing force;

wherein at least one of the intake valve and the exhaust valve includes a housing having a first end plate that defines an inlet, a second end plate that defines the outlet, and an intermediate plate located between the first and second end plates that defines a region in which the valve member is located.

15. An energy conversion device as claimed in claim 14, wherein the first end plate, the end second plate, and at least one of the intake valve member and the exhaust valve member are formed from magnetic material; and a magnet associated with the first and second end plates.

16. An energy conversion device, comprising:

a cylinder defining first and second longitudinal ends cylinder and including an exhaust port between the longitudinal ends;

a piston located within the cylinder and movable relative to the cylinder through an expansion stroke having an end and a return stroke;

the piston and cylinder being configured the piston covers exhaust port during at least a portion of the expansion stroke and uncovers the exhaust port near the end of the expansion stroke;

an intake valve associated with the first longitudinal end of the cylinder and including an outlet, an intake valve member being that is movable, between an open position in spaced relation to the outlet and a closed position that abuts the outlet, and a spring that provides a biasing force that biases the valve member to the open position; and a protrusion carried by the piston or the intake valve member such that the piston moves the intake valve member to the open position when the piston is adjacent to the intake valve.

17. An energy conversion device as claimed in claim 16, wherein the intake valve is configured such that the intake valve member will move to the closed position when flow through the intake valve reaches a critical flow rate.

18. An energy conversion device as claimed in claim 16, wherein the intake valve member comprises a conical valve member.

19. An energy conversion device as claimed in claim 16, wherein there is a maximum distance between the intake valve member and the outlet when the intake valve is open, the energy conversion device further comprising:

a control element movable relative to the intake valve member between a first position that prevents the intake valve member from being the maximum distance from the outlet when the intake valve is open and a second position that does not prevent the intake valve member from being the maximum distance from the outlet when the intake valve is open.

20. An energy conversion device as claimed in claim 16, wherein the protrusion is carried by the piston.

21. An energy conversion device as claimed in claim 16, wherein the protrusion is carried by the intake valve member.

22. An energy conversion device as claimed in claim 16, wherein the intake valve defines a first intake valve and the protrusion defines a first protrusion, the energy conversion device further comprising:

a second intake valve associated with the second longitudinal end of the cylinder and including an outlet and an intake valve member, the intake valve member being movable between an open position in spaced relation to the outlet and a closed position that abuts the outlet and biased to the open position by a biasing force;

a second protrusion carried by the piston or the intake valve member of the second intake valve such that the piston moves the intake valve member of the second intake valve to the open position when the piston is adjacent to the second intake valve.

23. An energy conversion device as claimed in claim 22, further comprising:

a linearly movable output shaft connected to the piston.

24. An energy conversion device as claimed in claim 22, wherein the piston comprises a magnet, the energy conversion device further comprising:

at least one coil that extends around the cylinder.

25. An energy conversion device as claimed in claim 16, wherein the piston is operably connected to a crankshaft.

26. An energy conversion device as claimed in claim 16, wherein the cylinder comprises a plurality of cylinders;

the piston comprises a plurality of pistons respectively located within the plurality of cylinders;

the intake valve comprises a plurality of intake valves respectively associated with the plurality of cylinders; and the protrusion comprises a plurality of protrusions respectively carried by the plurality of pistons.

27. An energy conversion device, comprising:

a cylinder defining first and second longitudinal ends cylinder and including an exhaust port between the longitudinal ends;

a piston located within the cylinder and movable relative to the cylinder through an expansion stroke having an end and a return stroke;

the piston and cylinder being configured the piston covers exhaust port during at least a portion of the expansion stroke and uncovers the exhaust port near the end of the expansion stroke;

an intake valve associated with the first longitudinal end of the cylinder and including an outlet and a resilient intake valve member that includes first and second substantially planar portions and a curved portion between the first and second substantially planar portions, the intake valve member being movable, between an open position in spaced relation to the outlet and a closed position that abuts the outlet, and self-biased to the open position by a biasing force; and a protrusion carried by the piston or the intake valve member such that the piston moves the intake valve member to the open position when the piston is adjacent to the intake valve.

28. An energy conversion device, comprising:

a cylinder defining first and second longitudinal ends cylinder and including an exhaust port between the longitudinal ends;

a piston located within the cylinder and movable relative to the cylinder through an expansion stroke having an end and a return stroke;

the piston and cylinder being configured the piston covers exhaust port during at least a portion of the expansion stroke and uncovers the exhaust port near the end of the expansion stroke;

an intake valve associated with the first longitudinal end of the cylinder and including a housing and an intake valve member, the housing having a first end plate that defines an inlet, a second end plate that defines an outlet, and an intermediate plate located between the first and second end plates that defines a region and the intake valve member being located in the region and movable, between an open position in spaced relation to the outlet and a closed position that abuts the outlet, and biased to the open position by a biasing force; and a protrusion carried by the piston or the intake valve member such that the piston moves the intake valve member to the open position when the piston is adjacent to the intake valve.

29. An energy conversion device as claimed in claim 28, wherein the first end plate, the end second plate, and the intake valve member are formed from magnetic material; and a magnet associated with the first and second end plates.

* * * * *